US007073304B2

(12) United States Patent
Hampton et al.

(10) Patent No.: US 7,073,304 B2
(45) **Date of Patent: *Jul. 11, 2006**

(54) CORNER BUILDING BLOCK, SYSTEM AND METHOD

(76) Inventors: Robert D. Hampton, 5515 S. 96th Pl., Lincoln, NE (US) 68526; John J. Gran, 6843 Glassridge Pl., Lincoln, NE (US) 68526

( * ) Notice: Subject to any disclaimer, the term of this patent is extended or adjusted under 35 U.S.C. 154(b) by 196 days.

This patent is subject to a terminal disclaimer.

(21) Appl. No.: 10/948,527

(22) Filed: Sep. 23, 2004

(65) Prior Publication Data

US 2005/0055944 A1 Mar. 17, 2005

Related U.S. Application Data

(63) Continuation-in-part of application No. 10/375,769, filed on Feb. 27, 2003, now Pat. No. 6,796,098, which is a continuation-in-part of application No. 09/978,609, filed on Oct. 16, 2001, now abandoned.

(51) Int. Cl.
*E04C 2/04* (2006.01)

(52) U.S. Cl. ..... 52/603; 52/125.2; 52/125.4; 52/604; 52/606; 52/745.09; 52/741.13; 405/286; 405/284

(58) Field of Classification Search ..... 52/122.1, 52/125.2, 125.4, 600, 603, 604, 606–607, 52/741.13, 745.05, 745.09; 294/89; 405/284, 405/262, 286
See application file for complete search history.

(56) References Cited

U.S. PATENT DOCUMENTS

| | | | | |
|---|---|---|---|---|
| 5,688,078 | A | 11/1997 | Hammer | |
| 6,062,772 | A | 5/2000 | Perkins | |
| 6,082,933 | A | 7/2000 | Maguire et al. | |
| 6,168,353 | B1 | 1/2001 | Price | |
| 6,176,049 | B1 | 1/2001 | Crant et al. | |
| 6,193,445 | B1 | 2/2001 | Scales | |
| 6,796,098 | B1 * | 9/2004 | Hampton | 52/603 |
| 2001/0019684 | A1 | 9/2001 | Manthei et al. | |
| 2001/0026734 | A1 | 10/2001 | Manthei | |
| 2002/0030303 | A1 | 3/2002 | Manthei et al. | |

* cited by examiner

*Primary Examiner*—Naoko Slack
*Assistant Examiner*—Chi Q. Nguyen
(74) *Attorney, Agent, or Firm*—Martin & Associates, L.L.C.; Derek P. Martin

(57) ABSTRACT

A block has a finished surface that provides an attractive appearance. The block is relatively large in size, allowing the quick construction of a wall, such as a retaining wall, using the block. The block includes one or more lift and alignment devices in the block that allow the block to be lifted using a suitable lifting apparatus, such as a crane, forklift, backhoe, etc. The block includes one or more recessed portions in the bottom surface of the block positioned to receive the protruding lift and alignment device of a previously-laid block underneath, thereby helping to align the block with the previously-laid block. The block includes one or more voids that extend from the top surface to the bottom surface of the block, and that align with each other when the blocks are stacked into a wall, thereby allowing fill material to be placed in the voids to strengthen the wall. The preferred embodiments also include a wall system with various different blocks that may be used to build a wall.

29 Claims, 14 Drawing Sheets

520

FIG. 32
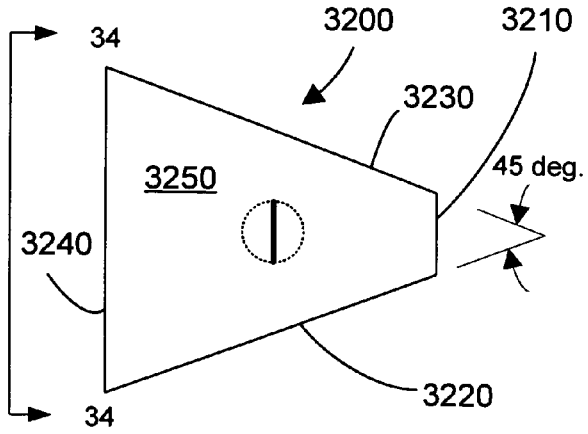
FIG. 33
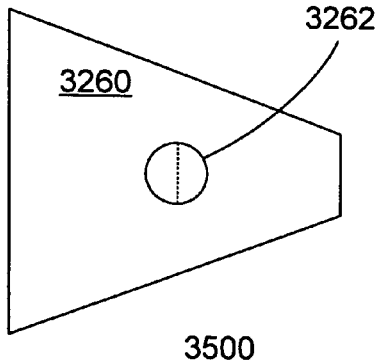
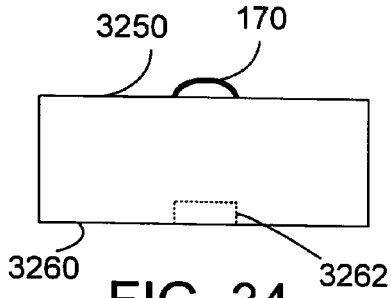
FIG. 34
FIG. 35
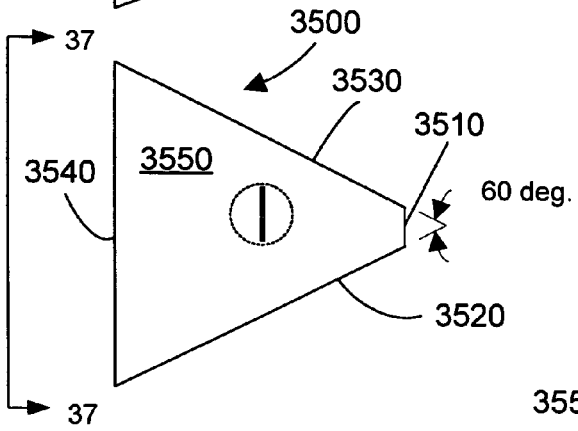
FIG. 36
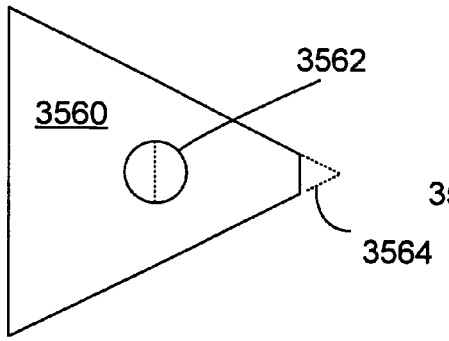
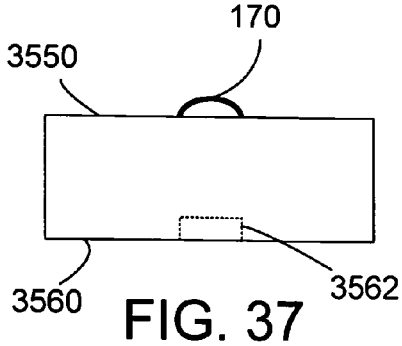
FIG. 37

CORNER BUILDING BLOCK, SYSTEM AND METHOD

PARENT APPLICATION

This application is a Continuation-In-Part (CIP) of the patent application "BUILDING BLOCK, SYSTEM AND METHOD", Ser. No. 10/375,769 filed on Feb. 27, 2003, now U.S. Pat. No. 6,796,098, which is a CIP of "BUILDING BLOCK", Ser. No. 09/978,609 filed on Oct. 16, 2001, now abandoned which are both incorporated herein by reference.

BACKGROUND OF THE INVENTION

1. Technical Field

This invention generally relates to construction materials and techniques, and more specifically relates to a building block wall system and method that may be used to construct a wall or support.

2. Background Art

Building blocks have been used for centuries to construct homes, office buildings, churches, and many other structures. Early building blocks were hewn from stone into appropriate shapes that were assembled together, typically using mortar, to form a wall. In modern times, various types of concrete blocks have been developed, which are typically formed by pouring a cement-based concrete mixture into a form and allowing the concrete to cure. This type of concrete block is strong and makes for a sturdy wall, but installing a traditional concrete block requires a skilled mason that must manually lift each block, and set each block using mortar to secure the blocks in place. This process is very labor-intensive.

One application for concrete blocks is the construction of retaining walls. Retaining walls are required when there is a body of earth that needs to be held in place. While several different block designs have been used in the art, most of these are relatively small blocks that a construction worker must manually lift and put in place. Most require mortar. What is needed is a large block that is especially well-suited for retaining walls that has a large surface, and that may be lifted into place using a crane or other suitable equipment, and that may be stacked into a wall without mortar. This allows a wall to be quickly and efficiently constructed using much less skilled labor. It would also be desirable for the block to have an attractive, finished look that does not require covering or painting, but that also could be stained to look like many different types of rocks or stones or to match a desired color scheme. Further, it would be desirable to have corner blocks that allow the wall to have a variety of angles to produce various wall contours.

DISCLOSURE OF INVENTION

According to the preferred embodiments, a system of blocks has a finished surface that provides an attractive appearance. The blocks are relatively large in size, allowing the quick construction of a wall, such as a retaining wall, using the blocks. The blocks include one or more lift and alignment devices in the block that allow the block to be lifted using a suitable lifting apparatus, such as a crane, forklift, backhoe, etc. The blocks include one or more recessed portions in the bottom surface of the block positioned to receive the protruding lift and alignment device of a previously-laid block underneath, thereby helping to align the block with the previously-laid block. Some embodiments of the blocks includes one or more voids that extend from the top surface to the bottom surface of the block, and that align with each other when the blocks are stacked into a wall, thereby allowing fill material to be placed in the voids to strengthen the wall. The preferred embodiments also include a wall system with various different blocks that may be used to build a wall, including corner blocks that allow abruptly changing the direction of the wall.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and:

FIG. 32 is a top view of a 45 degree corner block in accordance with preferred embodiments;

FIG. 33 is a bottom view of the 45 degree corner block in FIG. 32;

FIG. 34 is a side view of the 45 degree corner block in FIG. 32 taken along the lines 34—34;

FIG. 35 is a top view of a 60 degree corner block in accordance with preferred embodiments;

FIG. 36 is a bottom view of the 60 degree corner block in FIG. 35;

FIG. 37 is a side view of the 60 degree corner block in FIG. 35 taken along the lines 37—37;

BEST MODE FOR CARRYING OUT THE INVENTION

Figure 1:
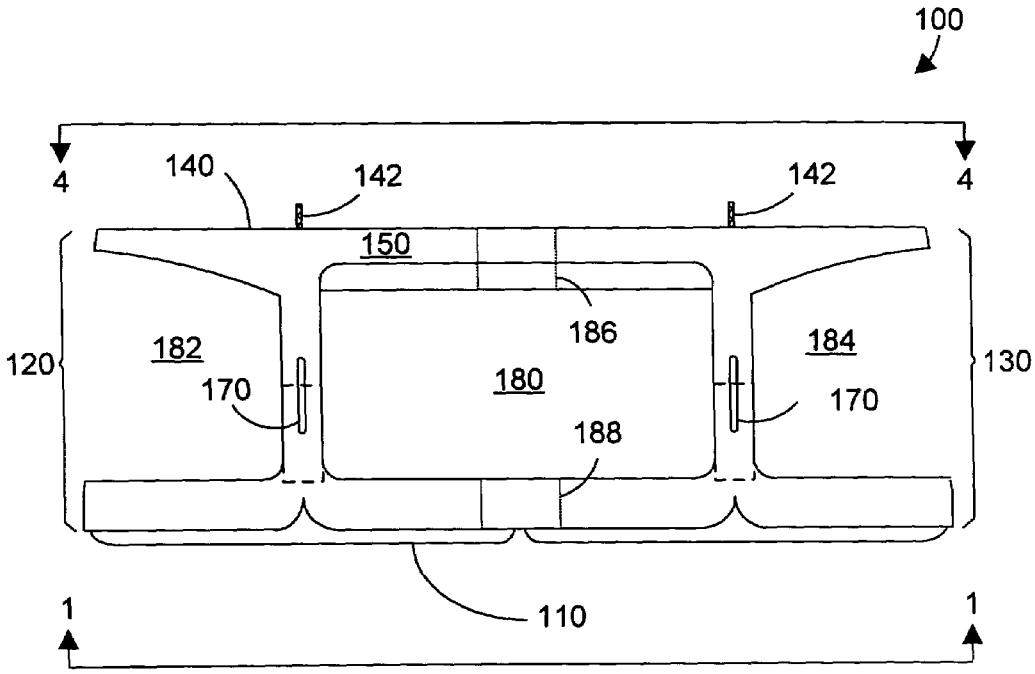
FIG. 1 is a top view of a block in accordance with the preferred embodiments.
Figure 2:
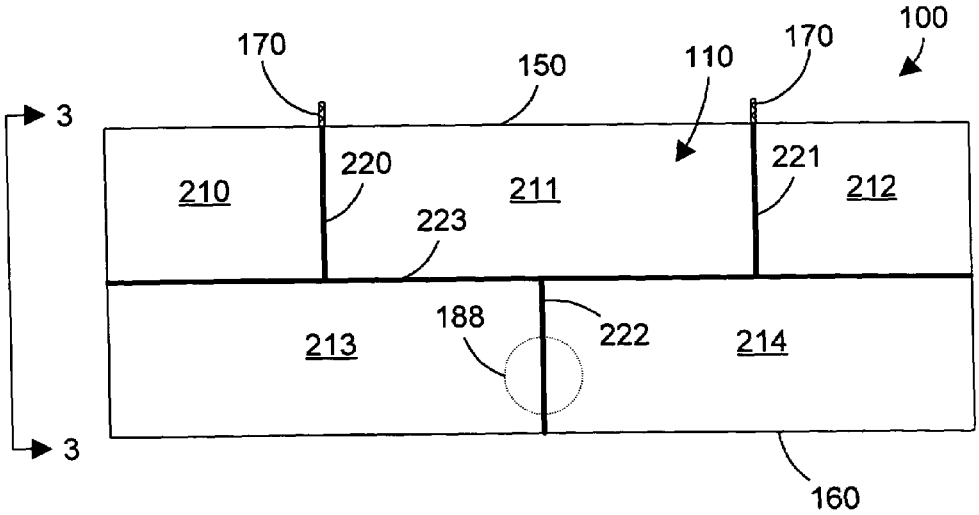
FIG. 2 is front view of the block of FIG. 1 taken along the lines 1—1.

Referring now to FIGS. 1–4, a building block 100 in accordance with the preferred embodiment includes a front surface 110, a left side surface 120, a right side surface 130, and a back surface 140, all coupled together via a top surface 150 and a bottom surface 160. The front surface 110 is preferably wider than the back surface 140. In the specific configuration in the drawings there is a 4.5° taper from front surface 110 to back surface 140. The preferred embodiments extend to any taper angle, no taper angle, or a negative taper angle that would make the back surface 140 wider than the front surface 110. In the preferred embodiments, any or all of the front surface 110 and the side surfaces 120 and 130 could have a finished, decorative surface. In the specific embodiment shown in FIGS. 1–3, we assume that front surface 110 has a decorative surface as shown in FIG. 2. Front surface 110 has the appearance of stone that has been stacked together using mortar joints. Each rectangular panel 210, 211, 212, 213, and 214 represent a stone, while the lines between the panels 220, 221, 222 and 223 represent mortar joints between the stones. Each panel 210–214 preferably has a textured finish that gives the panels a stone-like appearance. Note, however, that any suitable finish may be used for any of the front surface 110 and side surfaces 120 and 130, and that the block material may be colored and the finished surface may be stained or painted to achieve a desired look. The preferred embodiments expressly extend to any type of finished surface on block 100. Further note that the references to "front surface" and "back surface" are used for reference only, and may be interchanged one for the other.

Figure 3:
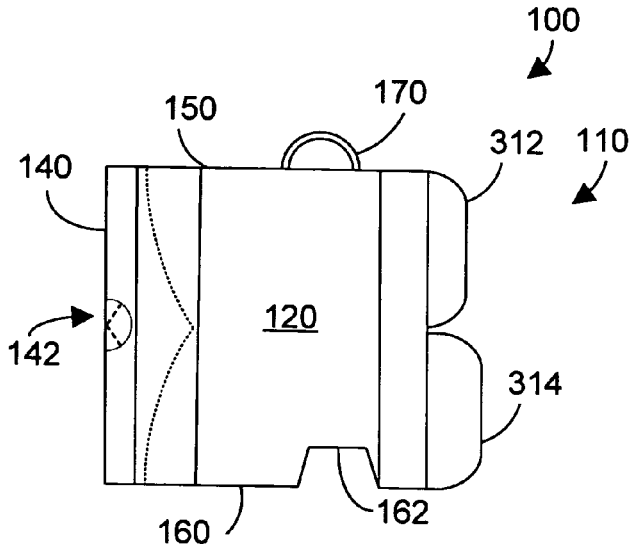
FIG. 3 is a side view of the block of FIGS. 1 and 2 taken along the lines 3—3 in FIG. 2.

Referring to FIG. 3, for the specific configuration shown in the drawings, the front surface 110 has an uneven surface comprised of a lower finished surface 314 and an offset upper finished surface 312. The offset upper finished surface 312 gives the appearance of a separate course of stone, and enhances the look of a finished wall that is built using the block 100. The preferred embodiments, however, expressly extend to a block that has an even finished surface and that is placed in a wall to provide a straight, vertical wall surface.

Block 100 preferably includes one or more voids that extend from the top surface to the bottom surface of the block. Examples of suitable voids are shown in FIG. 1 to include a fully enclosed void 180 and two partially enclosed voids 182 and 184. When blocks 100 are laid next to each other, partially enclosed voids 182 and 184 of adjacent blocks combine to form a void similar in size to void 180. These voids are designed to align with voids of other blocks when the blocks are stacked to form a wall. The voids may be filled with an appropriate filler material, such as recycled concrete, gravel, concrete, etc. Filling the voids with an appropriate filler material increases the shear strength of a wall built using the block 100. The preferred embodiments also extend to a block 100 that is solid, and thus has no voids.

Block 100 is shown in FIG. 1 to include a first hole 186 that communicates between the back 140 of the block and the center void 180, and a second hole 188 that communicates between the front 110 of the block and the center void 180. These holes are shown as examples of suitable openings that may be optionally included in a block in accordance with the preferred embodiments. Hole 186 allows groundwater that would normally build up on the back side of a retaining wall to instead drain into the inner void 180. Hole 188 allows the water flowing in inner void 180 to exit the wall and drain away. In addition, these holes 186 and 188 could be used to run conduit, plumbing, or other items within a wall. The preferred embodiments extend to any geometry of openings. The preferred embodiments also extend to a block where the hole 188 does not go completely through the exterior of front surface 110, but could be opened after the block is in a wall by a suitable tool, such as a hammer, drill, etc. This configuration is shown in FIG. 2, where hole 188 is shown in phantom because it does not extend through the front face 110 of block 100. The presence of holes 186 and 188 in block 100 is optional, because the cracks between blocks may allow water to flow into the voids in sufficient quantity to provide the required drainage for a retaining wall.

Block 100 preferably includes one or more devices that allow lifting the block 100. For example, block 100 in the figures includes two semicircular lift and alignment rings 170 (best shown in FIG. 3) that protrude from the top surface 150 of the block that allow the block to be lifted using a suitable lifting apparatus, such as a crane, forklift, backhoe, etc. Block 100 preferably includes one or more alignment channels 162 (FIG. 3) in the bottom surface 160 of the block that helps align the block 100 with a previously-laid block underneath. The alignment channel 162 is recessed into bottom surface 160, as shown in FIG. 3. In the case where the block does not have one or more voids, then alignment channel 162 would preferably run the entire width of block 100. In the most preferred implementation, the radius of the outside of the lift and alignment rings 170 is preferably 4 inches (10.2 cm), and the alignment channel 162 is configured to receive a lift and alignment ring with a radius of 4.5 inches (11.4 cm). The lift and alignment rings 170 may be made of any suitable material that provides sufficient strength to allow lifting the block 100 using the lift and alignment rings 170. In the preferred embodiments, lift and alignment rings 170 are made of No. 6 rebar with a non-corrosive coating, such as fiberglass resin. No. 6 rebar refers to a specific rebar diameter; however, the preferred embodiments include any suitable rebar diameter and any suitable coating. In addition, lift and alignment rings 170 may be made of stainless steel or other non-corrosive material which could be used in a corrosive environment, such as on an ocean shoreline. Additionally, the preferred embodiments include any suitable radius of the lift and alignment rings 170 and any suitable geometric configuration for channel 162 to receive the lift and alignment rings 170.

The semicircular shape of protruding portion of the lift and alignment rings 170 shown in FIG. 3 and the shape of the alignment channels 162 provide a mechanism for easily aligning a block on top of a previously-laid block. The block 100 of FIG. 1 is preferably heavy enough that it will typically be set in place using suitable equipment, such as a crane. The lift and alignment rings 170 provide easy loops for attaching hooks to lift the block 100. As the block is lowered into place on previously-set blocks, the shape of the alignment channel 162 has an aligning effect on the block as it is lowered onto the lift and alignment rings 170 of one or more previously-laid blocks. If the block is slightly too far to the front or back, the weight of the block will cause the block to shift as it is lowered until the lift and alignment rings 170 lie within the alignment channels 162. This is the how the lift and alignment rings 170 perform their aligning function. The lift and alignment rings thus provide a dual function. They provide lift hooks that allow lifting the block and placing it in a wall. They also provide an alignment mechanism to align the alignment channel of a subsequently-placed block with one or more lift and alignment devices of one or more blocks that have been previously placed. This dual function for lift and alignment rings 170 provide significant advantages over known building blocks.

While lift and alignment rings 170 are shown herein in a semicircle shape, and alignment channel is shown as a channel with beveled sides, the preferred embodiments expressly extend to any and all suitable geometries for lift and alignment rings 170 and alignment channel 162. For example, a semicircular lift and alignment ring 170 could be used with a rectangular or square alignment channel 162. In the alternative, both lift and alignment ring 170 and alignment channel 162 may be triangular in shape. Any suitable geometric shape for the lift and alignment ring 170 may be used with any compatible geometric shape for the alignment channel within the scope of the preferred embodiments.

Figure 4:
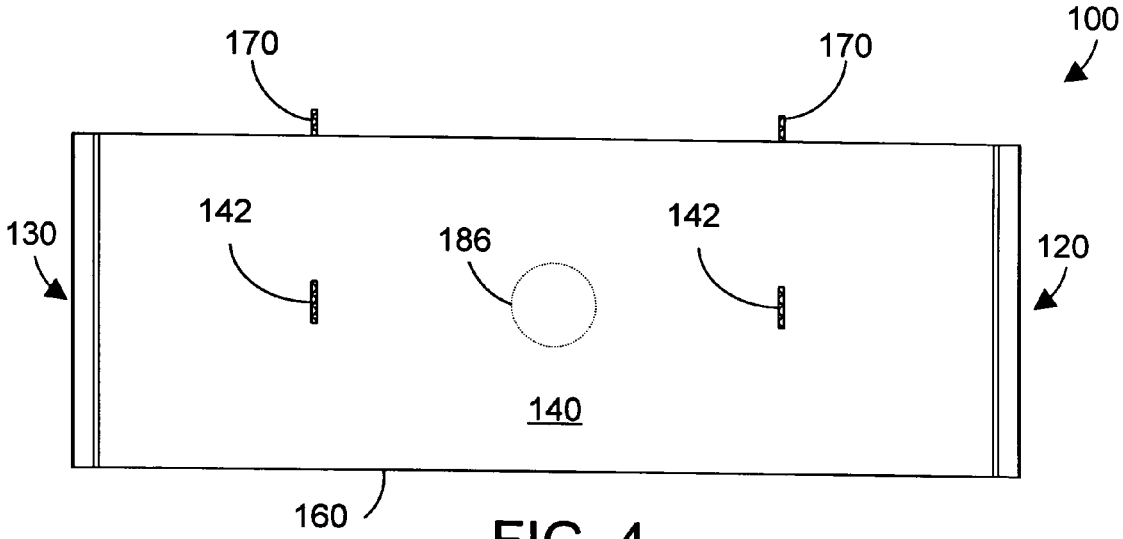
FIG. 4 is a back view of the block of FIG. 1 taken along the lines 4—4 in FIG. 1.
Figure 5:
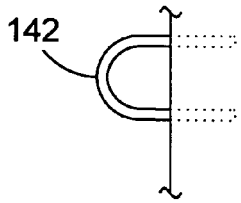
FIG. 5 is an enlarged detail view of the lifting device 142 shown in FIG. 3.

FIG. 4 shows the back surface 140 of the block 100, including the hole 186, and the one or more lifting devices 142. FIG. 5 is an enlarged view of the lifting device 142 (shown in the orientation of FIG. 3). In the preferred embodiments, lifting device 142 comprises piece of rebar bent in a U-shape as shown in FIG. 5 that is embedded in the block 100. The preferred embodiments expressly extend to any suitable configuration for a lifting device 142 or a number of different lifting devices 142 that are capable of supporting the weight of the block 100. In the preferred embodiments the lifting devices 142 are used to remove the block 100 from a form used to create the block, while the lift and alignment rings 170 are used to lift the block and place the block in its final position in a wall. Of course, other variations are within the scope of the preferred embodiments.

Figure 6:
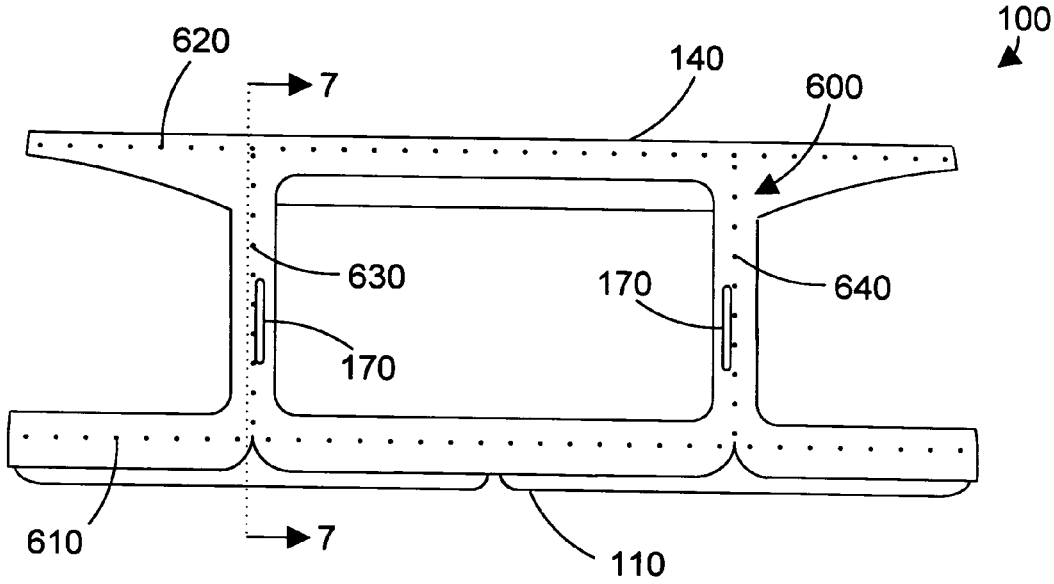
FIG. 6 is a top view of the block of FIG. 1 showing a reinforcing structure that adds strength to the block.

Referring now to FIG. 6, the block 100 preferably includes a reinforcing structure within the block that provides structural strength to the block. A suitable reinforcing structure 610 is shown in FIG. 6 to include a front piece 610 that runs the width of the front surface 110, a back piece 620 that runs the width of the back surface 140, a left side piece 630, and a right side piece 640. Each of these pieces preferably provide a grid-like structure that reinforces the concrete in the block. In the preferred embodiments, D4 metal wire mesh, grade 80 with a spacing of 4 inches (10.2 cm) is used. Each piece is secured to the adjacent other pieces using any suitable technique, such as tying with wire, welding, etc. In the preferred embodiments, the different pieces of the reinforcing structure 610 are attached to each other using wire that is tied around both adjacent pieces. Of course, the preferred embodiments extend to any suitable reinforcing structure that adds structural strength to the block, regardless of its composition or configuration. For example, rebar may be used instead of wire mesh. The reinforcing structure 610 provides structural reinforcement that allows the block 100 to be used in tall walls or in load-bearing applications, if required.

Figure 7:
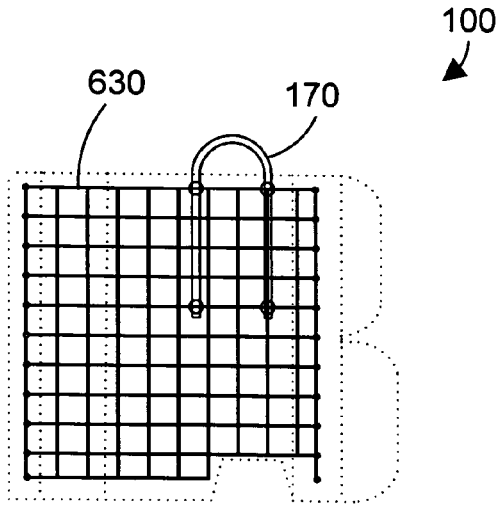
FIG. 7 is cross-sectional view of the block in FIG. 6 taken along the lines 7—7 that shows the connection of lift and alignment ring 170 to the reinforcing structure.

For the preferred implementation that uses 4 inch (10.2 cm) metal wire mesh, a cross-sectional side view taken along the line 7—7 in FIG. 6 is shown in FIG. 7. Note that the block 100 is shown in phantom in FIG. 7 to more clearly show how the lift and alignment ring 170 is attached to the left side piece 630 of the reinforcing structure 610. One specific way to attach the lift and alignment ring 170 to the left side piece 630 of the reinforcing structure 610 is to wire the two together at the points indicated with small circles in FIG. 7. Of course, welding or any type of fastener could also be used. By attaching the lift and alignment rings 170 to the reinforcing structure 610 of the block, the lift and alignment rings 170 will not pull out of the block 100 under the weight of lifting the block 100. Note that the size and properties of the reinforcing structure 610 and lift and alignment rings 170 may vary according to the engineering requirements for a wall constructed using the block 100. For some walls, such as relatively short, non-load bearing retaining walls, the reinforcing structure 610 may be omitted altogether.

Block 100 is preferably comprised of a mixture of sand, gravel, cement, and water that is poured around the reinforcing structure 610 and the attached lift and alignment rings 170 to form a block. The cement is preferably Portland cement, type 1, ASTM designation C150 or similar. The resulting mix is preferably denoted L4000, which represents a mixture of sand, gravel, cement, and water in proportions that results in a finished product capable of bearing approximately 4000 pounds per square inch (280 kilograms per square centimeter). L4000 mix preferably includes entrained air, which helps the block withstand freeze and thaw cycles. Note that L4000 is a common expression in the concrete art that denotes specific proportions of the ingredients. While L4000 is the preferred block material, the preferred embodiments also extends to any other suitable block material.

Figure 8:
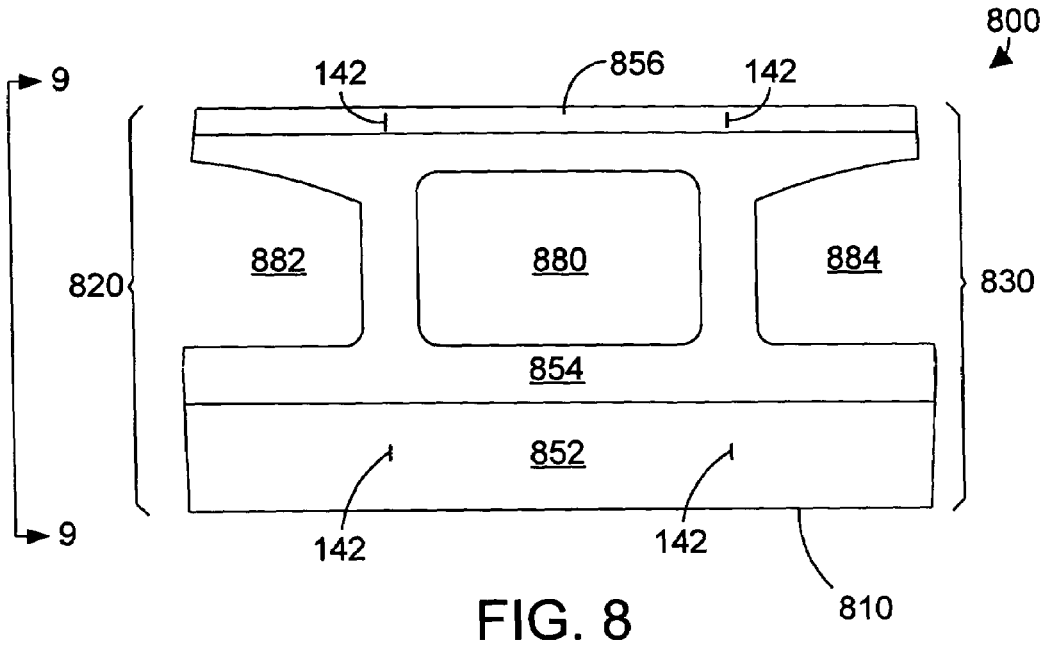
FIG. 8 is a top view of a footing block in accordance with the preferred embodiments.
Figure 9:
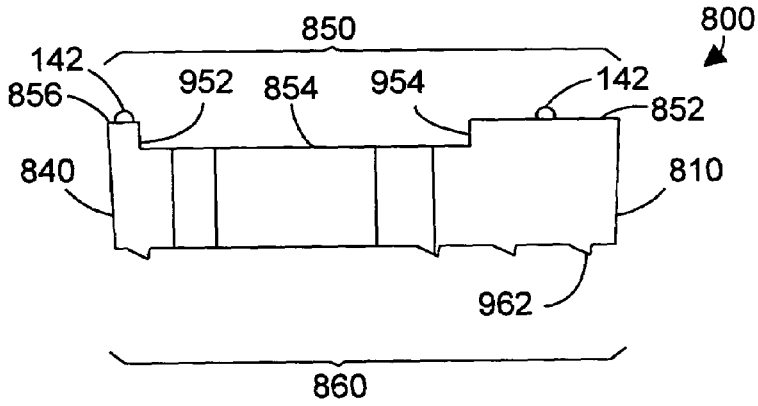
FIG. 9 is a side view of the block in FIG. 8 taken along the line 9—9.

Referring now to FIGS. 8 and 9, a footing block 800 in accordance with the preferred embodiment includes a front surface 810, a left side surface 820, a right side surface 830, and a back surface 840, all coupled together via a top surface 850 and a bottom surface 860. In the specific embodiment shown in FIGS. 8–9, we assume that none of the surfaces are finished. Of course, any of the exposed surfaces could have a finished, decorative surface within the scope of the preferred embodiments.

The top surface 850 of footing block 800 includes a raised front portion 852 coupled to a recessed center portion 854 that is, in turn, coupled to a raised rear portion 856. The width of recessed center portion 854 is preferably larger than the width of a block 100 shown in FIG. 1, which allows a block 100 to fit within the recessed portion 854 when placed atop the footing block 800. The bottom portion 860 of footing block 800 preferably includes one or more retaining mechanisms that prevent the footing block 800 from moving once in place. In FIG. 9, the retaining mechanisms are shown as triangular cleats 962 that run the width of the footing block 800. Triangular cleats 962 provide resistance to the footing block 800 moving, especially in a forward direction. Of course, any suitable configuration for retaining mechanisms that help to anchor the footing block 800 in place are within the scope of the preferred embodiments. Note that stakes could also be installed within the voids 880, 882 and 884 of footing block 800 against any of the inside surfaces of the footing block to keep the footing block 800 in place. Note that the voids 880, 882 and 884 preferably align with the one or more void 180, 182 and 184 of a block 100. However, the footing block 800 could be used with any type of building block, included those not mentioned herein. Footing block 800 has a depth (i.e., distance from front to back) that is substantially greater than the depth of block 100, thereby providing a solid foundation for a wall built using blocks 100.

Figure 10:
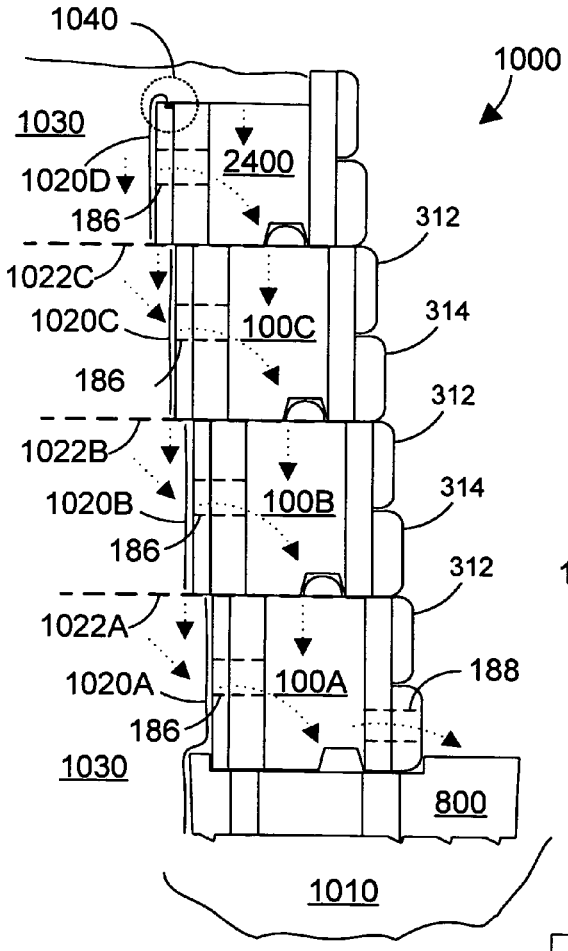
FIG. 10 is a side view of a retaining wall constructed using the block shown in FIGS. 1–7 and the footing block shown in FIGS. 8 and 9.
Figure 24:
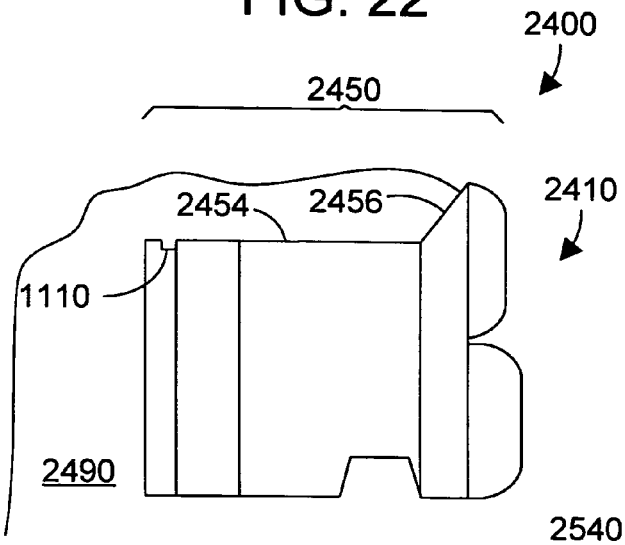
FIG. 24 is a side view of a first top block in accordance with the preferred embodiments.

FIG. 10 illustrates a profile view of a wall 1000 that includes a first row of footing blocks 800, followed by three rows of block 100 (shown as 100A, 100B and 100C), and topped off with a row of top blocks 2400 (described in more detail below with respect to FIG. 24). In the preferred embodiments the wall is constructed by first preparing the ground upon which the wall will be built. In the preferred implementation, a 12 inch (30.5 cm) gravel foundation, shown as 1010, is prepared; however, the preferred embodiments extend to any foundation suitable for the purposes for which the blocks are used, or to no foundation at all. Next, a footing block 800 is laid, and a row of blocks 100, shown as 100A, is placed on the footing block 800. The preferred embodiments also extend to placing block 100A on the gravel foundation 1010 without the use of a footing block 200, and to placing block 100A directly on the ground if the ground is sufficiently stable and flat to accommodate the blocks 100A. After a row of blocks 100A is placed the voids are filled with filler material if desired, and the blocks 100A in the row are backfilled, shown as 1030 in FIG. 10. Next, the row of blocks 100B is laid on top of the blocks 100A. The lift and aligning rings 170 (FIG. 1) of the blocks 100A guide the placement of the blocks 100B via the alignment channels 162 (FIG. 3) of the blocks 100B, as shown in FIG. 10. Next the voids may be filled, and the wall is backfilled just as with the blocks 100A. This continues with successive rows of blocks 100 to the level of one course below the desired height of the wall. Each additional row of blocks is offset from the row beneath so that the front face of the wall is staggered away from the bottom block, as shown in FIG. 10. This staggered surface provides an attractive wall, and provides enhanced structural properties for the wall because it pushes the weight and center of gravity of the wall back into the slope. In other words, each block is partially supported by the backfilled slope, giving the wall greater strength. The preferred embodiments extend to any amount of offset suitable for a particular application for the block, or to no offset at all. In the specific configuration shown in the drawings, the offset between blocks is such that finished surface 312 of the lower block is offset from the finished surface 314 of the block above the same amount that the finished surface 312 is offset from the finished surface 314 on the same block. Therefore the offset between the blocks matches the finished offset on each block 100, as illustrated in FIG. 10. Of course, if a straight vertical wall is desired, the offset between blocks may be zero, thereby aligning the front finished surface of all blocks to provide a straight, vertical wall.

In FIG. 10, a row of top blocks 2400 is placed on the top course to finish the wall. Note that a material separator fabric 1020 is preferably placed on the back side of the wall as the wall is constructed to prevent dirt from entering into the cracks between the blocks 100, but to allow water to flow through to assure adequate drainage. The term "material separator fabric" is used herein to denote that the fabric creates a permeable barrier between the backfill material and the blocks, thereby allowing water to flow through while providing separation between the backfill material and the gravel or other fill material in the voids of the blocks. Material separator fabric 1020 preferably comprises a rolled sheet of non-woven polyester fabric that resists soil corrosion and is water permeable, similar to weed blocker fabric that is available at most home and garden stores. The preferred embodiments extend to any type of fabric material that will allow water to pass but keep the backfill 1030 out of the voids in the wall. The manner of applying the material separator fabric 1020 depends on whether or not the wall requires reinforcement. For walls 12 feet (3.66 m) high or more, a reinforcing fabric 1022 may be used to anchor the wall to the soil behind it. One suitable reinforcing fabric that is commercially available is known as geogrid, which is a polyester fabric weave designed to anchor walls to backfilled soil.

The wall of FIG. 10 includes reinforcing fabric between the blocks to anchor the blocks to the soil behind the wall. For example, reinforcing fabric 1022A is placed atop the first course of main blocks 100A before lowering the second course of blocks 100B in place. Once the second course 100B is in place, the weight of the blocks 100B keep the reinforcing fabric between the courses, and the other end of the reinforcing fabric is the extended away from the wall (left in FIG. 10) into the backfill to reinforce the wall 1000. In similar fashion, reinforcing fabric 1022B is shown between blocks 100B and blocks 100C, and reinforcing fabric 1022C is shown between blocks 100C and blocks 2400. When reinforcing fabric is used as shown in FIG. 10, the material separator fabric 1020 is placed after each course, resulting in separate pieces 1020A, 1020B, 1020C and 1020D. Of course, when reinforcing fabric is not used, the material separator fabric 1020 may be run in a solid sheet behind the wall without breaks. In this situation, the material separator fabric 1020 is unrolled enough to cover the entire back surface 140 before the backfill 1030 is applied. The material separator fabric 1020 continues to be unrolled with each successive row of blocks.

Figure 11:
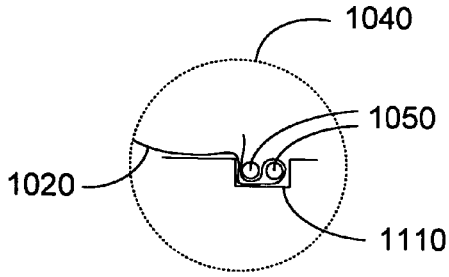
FIG. 11 is an enlarged view of a channel in the block in FIGS. 10 and 24 that may be used to secure a material separator fabric to the top of a wall.

The material separator fabric may be optionally secured to the top block at location 1040, which is shown in detail in FIG. 11. In the specific configuration shown in FIG. 11, a channel 1110 runs along the width of the top block 2400. The material separator fabric 1020 is wrapped around two rebar rods 1050, as shown in FIG. 11, that rest in channel 1110 and that span channels 1110 on many contiguous blocks. The rebar rods 1050 with the material separator fabric 1020 wrapped around them within the channel 1110 are then buried by the backfill 1030. The preferred embodiments extend to any type of securing device that would suitably hold the material separator fabric 1020 in place. The material separator fabric may simply be laid against the back of the blocks without attaching the material separator fabric to the top row of blocks. Thus, the preferred embodiments include blocks that do not include channel 1110.

The blocks 100A, 100B, 100C and 2400 shown in FIG. 10 may optionally include one or more holes 186 that allow groundwater to flow from the backfill material 1030 into the voids of the blocks. Each block in the bottom course of blocks 100A may also optionally include a hole 188 that allows water that flows in the block's inner void to exit the block and drain away. The flow of groundwater is shown in FIG. 10 by dotted arrows. Groundwater may flow through any of the holes 186 or through cracks between blocks into the inner void of each block or into the void between blocks. We assume for this particular application that the voids are filled with coarse gravel, which allows water to drain through the voids. Water may flow on the back side of the wall, and may enter at any hole 186 into the interior of the wall, and may also enter at the cracks between the blocks. Once the water reaches the bottom course, it exits out of the front hole 188. Note that hole 188 may be a simple drainage hole, or may include a drain tile or other coupling that allows a drainage pipe to be attached to the block. In the alternative, it is also within the scope of the preferred embodiments to embed any suitable pipe or conduit within the blocks for draining of groundwater or for running electricity, water, or other items within the wall.

The combination of the material separator fabric, joints between blocks, and aggregate fill material in the voids of the blocks results in a substantial advantage over the prior art. Known wall systems require a layer of gravel or other aggregate (typically a foot) be placed behind the wall to allow for drainage of groundwater. This results in a complicated backfill process, because soil must be pushed to within a foot of the wall, and gravel may then be place in the foot space behind the wall. This process continues up the wall, with some backfill being pushed into place, followed by filling the gap between the backfill and the wall with gravel. The wall system of the preferred embodiments does not require any gravel backfill in the wall, because gravel placed in the voids of the block can serve the drainage function as described above. As a result, the backfilling process is greatly simplified, allowing an operator of heavy equipment to simply push the soil against the material separator fabric on the back side of the wall with no need of adding gravel behind the wall for drainage.

Figure 12:
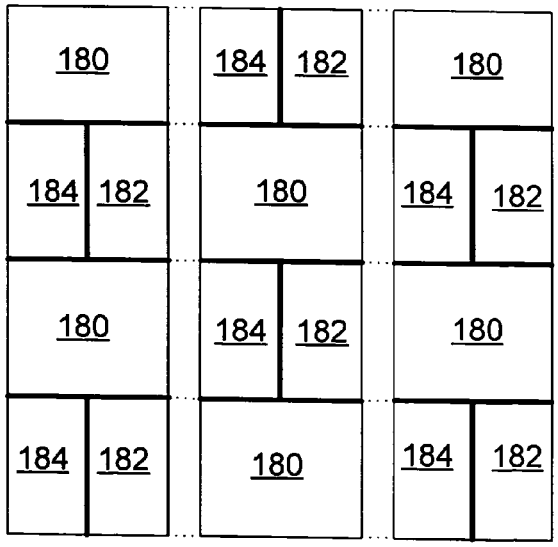
FIG. 12 is a front view of the voids created by the block in FIG. 1 when stacked with a running bond in accordance with the preferred embodiments.
Figure 13:
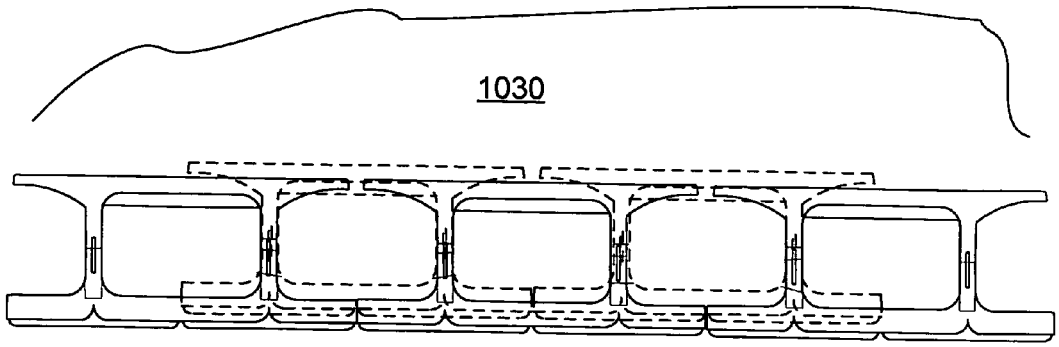
FIG. 13 is a top view of a straight wall with a portion of the second course of blocks in phantom to illustrate the continuity of voids in a wall constructed with the block in FIG. 1.
Figure 14:
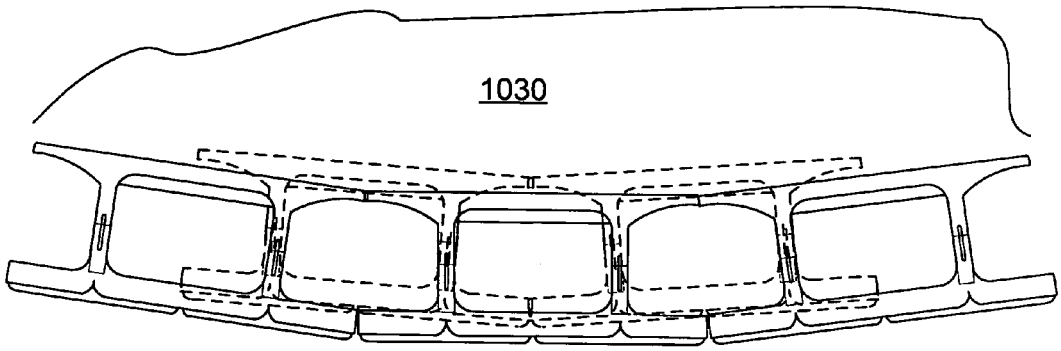
FIG. 14 is a top view that illustrates how a wall constructed of the block in FIG. 1 can create an outer curve and still maintain alignment of the voids, lift and aligning rings, and alignment channels.
Figure 15:
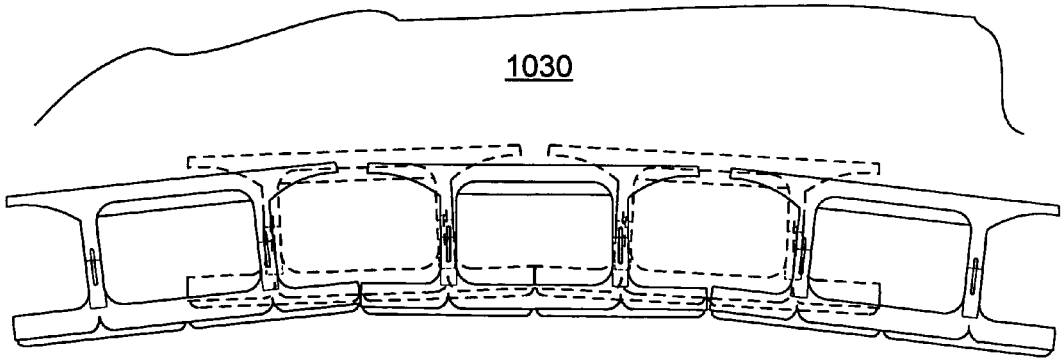
FIG. 15 is a top view that illustrates how a wall constructed of the block in FIG. 1 can create an inner curve and still maintain alignment of the voids, lift and aligning rings, and alignment channels.

Referring now to FIGS. 12–15, the voids in the wall system are generally aligned. FIG. 12 illustrates how the side areas 182 and 184 of two blocks 100 form a void that generally aligns with the void 180 of the block 100 beneath the two side areas. Note that only the voids of the blocks are shown in FIG. 12. FIGS. 13–15 show a bird's eye view of a wall with a first course shown in solid lines and part of a second course shown in phantom. This illustrates how the voids remain aligned regardless of whether the wall is straight (FIG. 13), or has an outside curve (FIG. 14) or an inside curve (FIG. 15). In the specific configuration in the drawings the blocks 100 may be used to make a wall that turns as much as a 50 foot (15.2 m) radius arc. The voids remain generally aligned when footing blocks 800 are used as the foundation for a wall. The voids 880, 882, and 884 (FIG. 8) and the adjoining side surfaces 820 and 830 (FIG. 8) of the footing blocks 800 align with the voids 180, 182 and 184 (FIG. 1) of the block 100.

The preferred embodiments extend to adding additional holes to the back surface 140 of a block 100. For example, a hole could be added that communicates between the back surface 140 and the void 182. Likewise, a hole could be added that communicates between the back surface 140 and the void 184. In addition, the preferred embodiments also extend to changing the relative widths of the front surface 110 and the back surface 140 on the block 100. Thus, the back surface 140 could be made wider than the front surface 110 when building the inside curve of a wall. The preferred embodiments expressly extend to any and all configurations and combination of front surface 110 and back surface 140.

Figure 16:
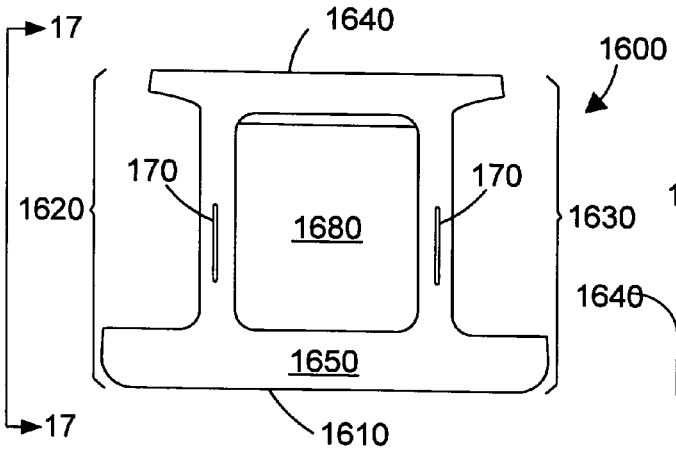
FIG. 16 is a top view of a half block in accordance with preferred embodiments.
Figure 17:
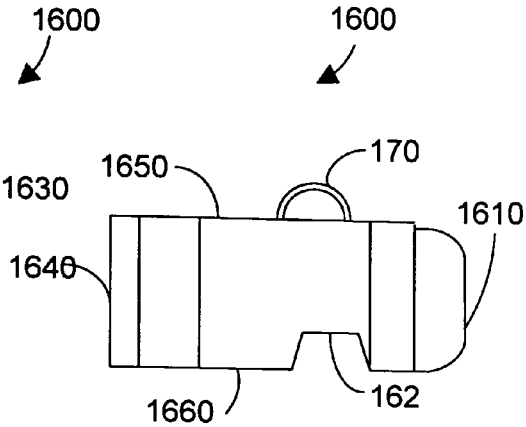
FIG. 17 is a side view of the block in FIG. 16 taken along the lines 17—17.
Figure 18:
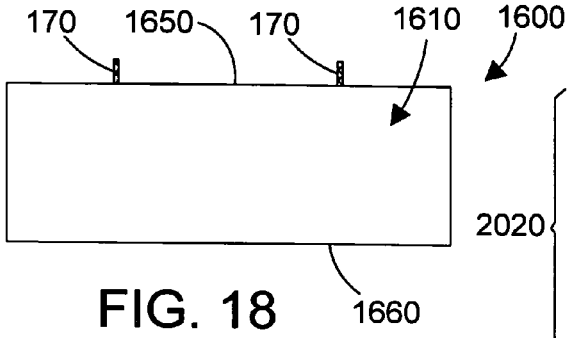
FIG. 18 is a first front view of the block in FIGS. 16 and 17.
Figure 19:
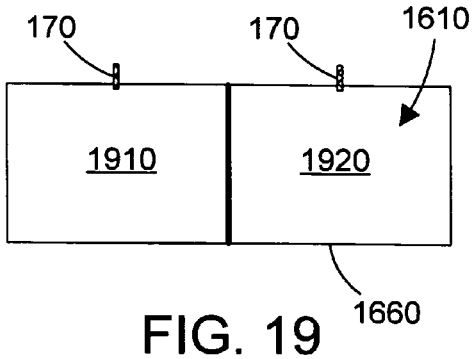
FIG. 19 is an alternative front view of the block in FIGS. 16 and 17.

The block 100 of FIGS. 1–7 and the footing block 800 of FIGS. 8 and 9 have been presented to this point. We refer to block 100 herein as the "main block". Now we present additional blocks that combine with the main block and footing block to create a wall system that allows for building a wide variety of different walls using the blocks. Referring to FIGS. 16 and 17, a half block 1600 preferably has a width that is half of the width of the main block 100 in FIG. 1, and preferably has a height that is half of the height of the main block 100. Half block 1600 includes a front surface 1610, a left side surface 1620, a right side surface 1630, a back surface 1640, a top surface 1650 and a bottom surface 1660. Half block 1600 preferably includes lift and alignment rings 170 and one or more alignment channels 162. The front face of the half block may be made with two alternative decorative faces. The first face is shown in FIG. 18, where the entire front face has the look of a single piece of stone. The second face is shown in FIG. 19, where the front face is divided in two to present the appearance of two different panels 1910 and 1920 of stone. Because the half block 1600 is half the height and half the width of the main block, these two different options of front face configuration shown in FIGS. 18 and 19 are necessary to keep a uniform appearance along a wall. Essentially, four small blocks 1600 with two on the bottom and two on the top could have the same appearance as one block 100 viewed from the front (see FIG. 2). The preferred embodiments extend to any finished surface on the half blocks 1600.

Figure 20:
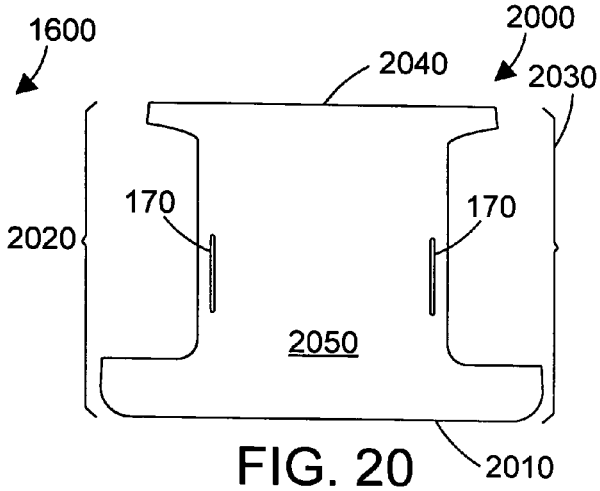
FIG. 20 is a top view of a transition block in accordance with the preferred embodiments.

Another block that is part of the overall wall system is referred to as a "transition block". One suitable implementation for a transition block 2000 is shown in FIG. 20, and preferably has the same dimensions as the half block 1600 of FIGS. 16–19. Transition block 2000 includes a front face 2010, a left side face 2020, a right side face 2030 a rear face 2040, and a top face 2050. The primary difference between transition block 2000 in FIG. 20 and half block 1600 in FIG. 16 is that the transition block 2000 has no inner void, but instead has a solid top surface 2050. This block is referred to herein as a "transition block" because it is used to make the transition from the main block 100 to a half block 1600, and vice versa. The transition block 2000 preferably does not have a center void because the lift and alignment rings 170 of the block below may fall within the void area of a transition block 2000. As a result, the transition block 2000 has a substantially solid bottom surface that includes an alignment channel in the form of a half-pipe that runs along the width of the transition block 2000. Note that the side view of the transition block 2000 is not shown separately because it is preferably identical to the side view of the half block 1600 shown in FIG. 17.

Figure 21:
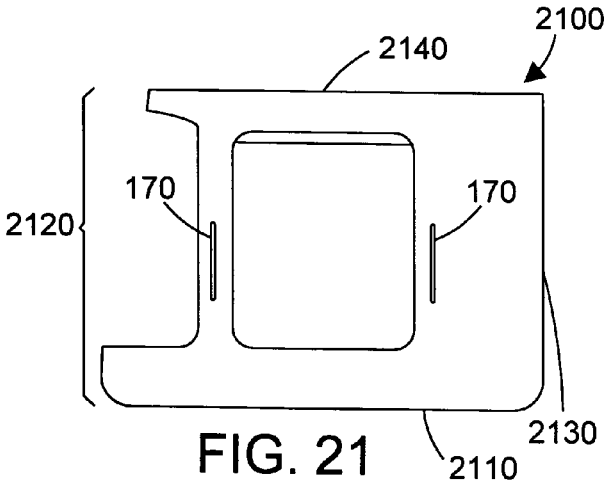
FIG. 21 is a top view of a half block that includes two finished sides.

Any of the blocks in the wall system disclosed herein may have finished, decorative surfaces on any of their faces or sides. Thus, as shown in FIG. 21, a special form of the half block 1600 is an end block 2100 that includes two finished surfaces, one on the front face 2110 and the other on the side face 2130. In this particular example, the left side surface 2120 and the back surface 2140 remain unfinished. Such a block could be used, for example, when the end of a wall is exposed.

Figure 22:
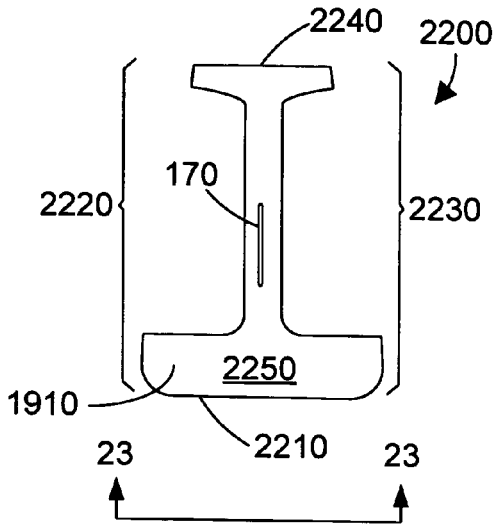
FIG. 22 is a top view of a quarter block in accordance with the preferred embodiments.
Figure 23:
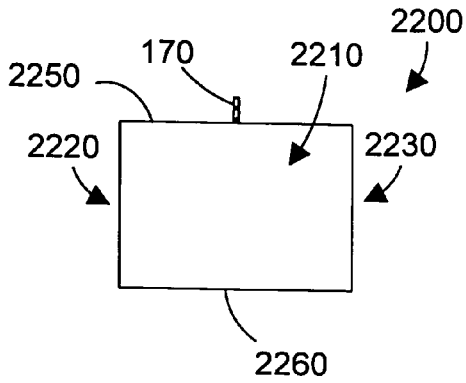
FIG. 23 is a front view of the quarter block in FIG. 22 taken along the lines 23—23.

Yet another block that is part of the overall wall system is shown in FIGS. 22 and 23. This block 2200 is referred to as a "quarter block", and preferably has a width that is one fourth the width of main block 100, and a height that is half of the height of the main block 100. Quarter block 2200 includes a front surface 2210, a left side surface 2220, a right side surface 2230, a rear surface 2240, a top surface 2250, and a bottom surface 2260. Quarter block 2200 also preferably includes a single lift and alignment ring 170, and a corresponding alignment channel on its bottom surface. The side surfaces 2220 and 2230 also match up with the side surfaces 1620 and 1630 of half blocks 1600 and with the side surfaces 2020 and 2030 of the transition blocks 2000 to form voids when the blocks are side by side. The front face 2210 of quarter block 2200 preferably has the appearance of a single stone, as shown in FIG. 23. Note that the side view of the quarter block 2200 is not shown separately because it is preferably identical to the side view of the half block 1600 shown in FIG. 17.

Figure 25:
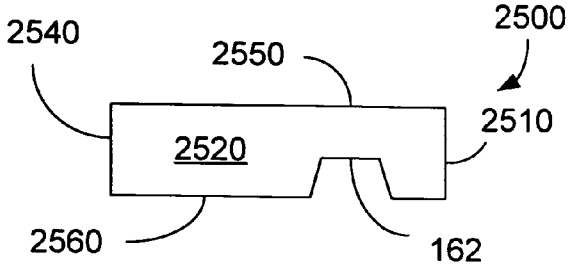
FIG. 25 is a side view of a second top block in accordance with the preferred embodiments.

Top blocks may also be used in the wall system of the preferred embodiments to top off a wall. Two examples of top blocks within the scope of the preferred embodiments are shown in FIGS. 24 and 25. FIG. 24 shows a side view for one specific implementation of a top block 2400. Note that block 2400 preferably does not have the lift and aligning rings 170, and has a top surface 2450 that includes a raised portion 2452 and a recessed portion 2454 connected by a step 2456. Recessed portion 2454 may optionally include a channel 1110 that runs the entire width of the block. Channel 1110 may be used to attach a material separator fabric to the top block, as discussed in detail above with reference to FIG. 11. Top block 2400 could be used with gravel, dirt, or concrete as the backfill material (shown as 2490 in FIG. 24) that overlies the recessed portion 2454 of top surface 2450, but does not overlie the raised portion 2452. This block could be used, for example, to provide a finished shore line for a lake or pond. Note that in the preferred embodiments of this block, the vertical portion of the step 2456 and the top surface 2452 could have a finished decorative surface in addition to the front surface 2410, thereby providing an attractive way to top off a retaining wall. Furthermore, the top block 2400 of FIG. 24 could be provided without voids, eliminating the need of filling the voids before the wall may be finished.

A second implementation of a top block is shown as block 2500 in FIG. 25. Top block 2500 includes a front face 2510, a left side face 2520, a right side face (not shown), a rear face 2540, a top face 2550, and a bottom face 2560. The bottom face 2560 preferably includes an alignment channel 162 positioned to receive the lift and alignment rings 170 from a block underneath. Any or all of the front surface 2510, left side face 2520, right side surface (not shown), and rear face 2540 could have a finished, decorative look that preferably matches the blocks underneath. The alignment channel 162 preferably runs the entire width of the block. Note that the configuration shown in FIG. 25 shows a top block 2500 that is approximately one fourth the height of the main block 100. Note, however, that top block 2500 may be any suitable height within the scope of the preferred embodiments. Example heights for top block 2500 that would be useful in a wall system include half the height of the main block 100 and the same height as the main block 100. Of course, the top block 2500 could be any other height within the scope of the preferred embodiments.

Another type of block that is part of the overall wall system is referred to as a "corner block." The corner blocks preferably have many of the same features as described above for the main block 100. Corner blocks in the present invention include a variety of angles between the side faces of the corner blocks. This variety of angles allows a wall to be built with a multiple contours as described further below. The angles illustrated in the following paragraphs are not all inclusive of the possible angles for corner blocks. The present invention expressly includes other angles for the corner blocks.

Figure 26:
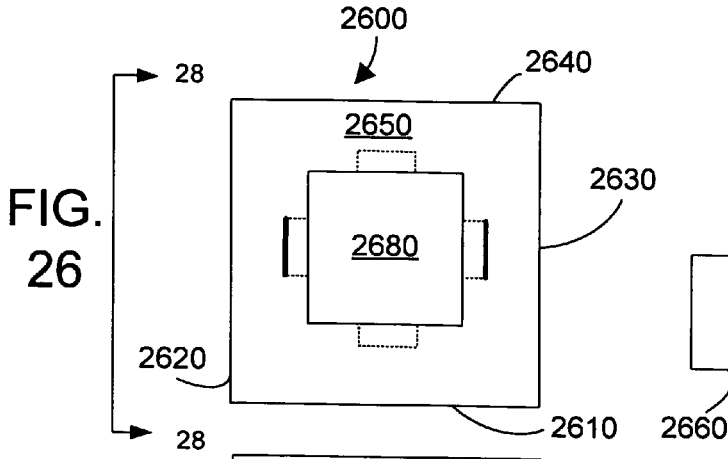
FIG. 26 is a top view of a square corner block in accordance with preferred embodiments.
Figure 28:
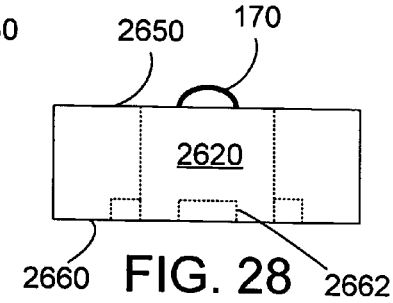
FIG. 28 is a side view of the square corner block in FIG. 26 taken along the lines 28—28.
Figure 27:
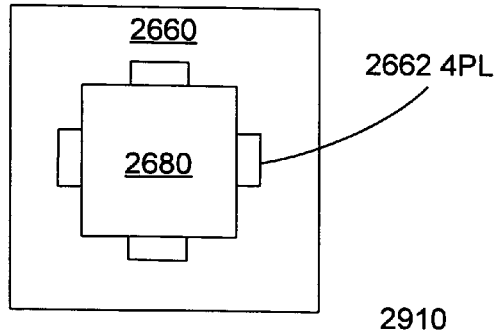
FIG. 27 is a bottom view of the square corner block in FIG. 26.

FIGS. 26 through 28 show a square corner block according to preferred embodiments. FIG. 26 shows a top view of a square corner block 2600. The square corner block 2600 preferably has a length and width that are the same as the front face 1610 of the quarter block 1600 of FIGS. 16–19. The square corner block 2600 includes a front face 2610, a left side face 2620, a right side face 2630 a rear face 2640, a top face 2650, and a bottom face 2660. Any or all of the front surface 2610, left side face 2620, right side face 2630, and rear face 2640 could have a finished, decorative look that preferably matches the other surrounding blocks. In the preferred embodiment at least two of the blocks faces are finished. The square corner block 2600 includes lift and alignment rings 170 (best shown in side view FIG. 28) that protrude from the top face 2650.

FIG. 27 shows a bottom view of the square corner block 2600. The square corner block 2600 preferably has a void 2680 through the center of the block from the top face 2650 to the bottom face 2660. The bottom face 2660 preferably includes alignment channels 2662 positioned to receive the lift and alignment rings 170 from a block underneath. The bottom face in the square block preferably also has four alignment channels 2662 positioned to receive the lift and alignment rings 170 when the top block is rotated 90 degrees. In this way, an upper square corner block 2600 in a wall can be positioned at any 90 degree rotation and the bottom face has appropriate alignment channels 2662 to receive the alignment rings 170 of a lower square block 2600. Note that the alignment channels 2662 are shown in phantom in FIGS. 26 and 28.

Figure 29:
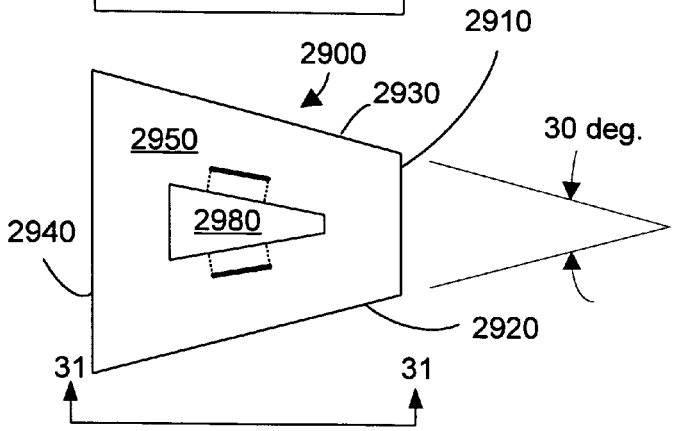
FIG. 29 is a top view of a 30 degree corner block in accordance with preferred embodiments.
Figure 30:
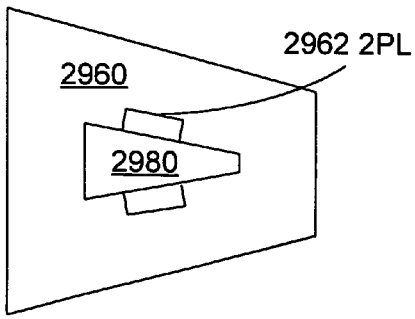
FIG. 30 is a bottom view of the 30 degree corner block in FIG. 29.
Figure 31:
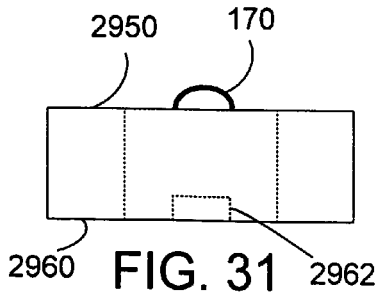
FIG. 31 is a side view of the 30 degree corner block in FIG. 29 taken along the lines 31—31.

FIGS. 29 through 31 show a 30 degree corner block according to preferred embodiments. FIG. 29 shows a top view of a 30 degree corner block 2900. The 30 degree corner block 2900 includes a front face 2910, a left side face 2920, a right side face 2930 a rear face 2940, a top face 2950, and a bottom face 2960. The angle between the left side face 2920 and the right side face 2930 is 30 degrees as shown in FIG. 29. Any or all of the front surface 2910, left side face 2920, right side face 2930, and rear face 2940 could have a finished, decorative look that preferably matches the other surrounding blocks. In the preferred embodiment at least the block's front face 2910 is finished. The 30 degree corner block 2900 includes lift and alignment rings 170 (best shown in side view FIG. 31) that protrude from the top face 2950.

FIG. 30 shows a bottom view of the 30 degree corner block 2900. The 30 degree corner block 2900 preferably has a void 2980 through the center of the block from the top face 2950 to the bottom face 2960. The bottom face 2960 preferably includes alignment channels 2962 positioned to receive the lift and alignment rings 170 from a block underneath.

FIGS. 32 through 35 show a 45 degree corner block according to preferred embodiments. FIG. 32 shows a top view of a 45 degree corner block 3200. The 45 degree corner block 3200 includes a front face 3210, a left side face 3220, a right side face 3230 a rear face 3240, a top face 3250, and a bottom face 3260. The angle between the left side face 3220 and the right side face 3230 is 45 degrees as shown in FIG. 32. Any or all of the front surface 3210, left side face 3220, right side face 3230, and rear face 3240 could have a finished, decorative look that preferably matches the other surrounding blocks. In the preferred embodiment at least the block's front face 3210 is finished. The 45 degree corner block 3200 includes lift and alignment rings 170 (best shown in side view FIG. 34) that protrude from the top face 3250.

FIG. 33 shows a bottom view of the 45 degree corner block 3200. The 45 degree corner block 3200 preferably does not include any voids that extend from the top face 3250 to the bottom face 3260. The bottom face 3260 preferably includes alignment channels 3262 positioned to receive the lift and alignment rings 170 from a block underneath.

FIGS. 35 through 37 show a 60 degree corner block according to preferred embodiments. FIG. 35 shows a top view of a 60 degree corner block 3500. The 60 degree corner block 3500 includes a front face 3510, a left side face 3520, a right side face 3530 a rear face 3540, a top face 3550, and a bottom face 3560. The angle between the left side face 3520 and the right side face 3530 is 60 degrees as shown in FIG. 35. Any or all of the front surface 3510, left side face 3520, right side face 3530, and rear face 3540 could have a finished, decorative look that preferably matches the other surrounding blocks. In the preferred embodiment at least the block's front face 3510 is finished. The 60 degree corner block 3500 includes lift and alignment rings 170 (best shown in side view FIG. 37) that protrude from the top face 3550.

FIG. 36 shows a bottom view of the 60 degree corner block 3500. The 60 degree corner block 3500 preferably does not inlcude any voids that extend from the top face 3550 to the bottom face 3560. The bottom face 3560 preferably includes alignment channels 3562 positioned to receive the lift and alignment rings 170 from a block underneath. FIG. 36 also shows an alternate embodiment of the 60 degree corner block 3500 having a triangular shape without a front face. This embodiment is illustrated by the dotted lines showing the 60 degree pointed surface 3564 between the first side surface 3510 and second side surface 3520 in FIG. 36.

Figure 38:
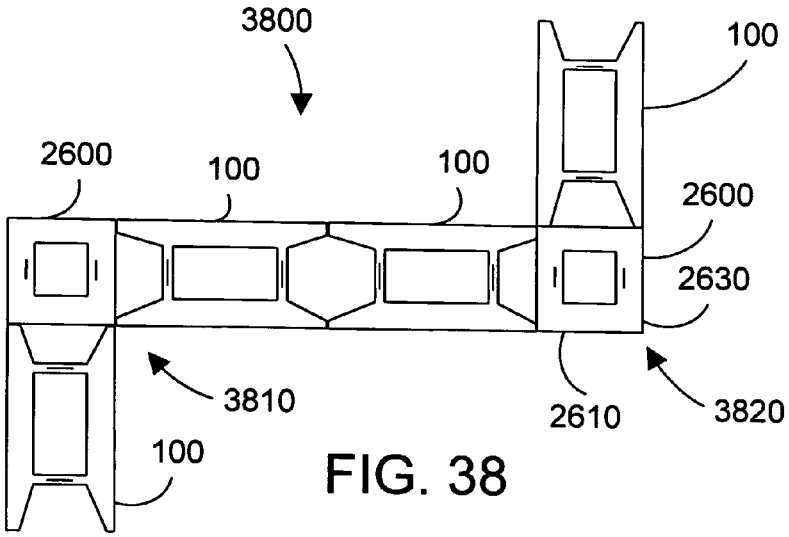
FIG. 38 is a top view of a wall built in accordance with the wall system and method of the preferred embodiments showing the square corner block in the wall system.

FIG. 38 shows a wall 3800 that includes a square corner block 2600 in the wall system of the preferred embodiments. This wall system illustrates the use of the square corner block 2600 described above and shown in FIG. 26 through FIG. 28. A square corner block 2600 is placed between two main blocks 100. One side of the two main blocks is disposed on a side of the corner block 2600 and preferably comes in contact with a side surface of the square corner block 2600. The corner block can be used to produce an inside corner 3810 or an outside corner 3820. In FIG. 38, the fill dirt is assumed to be above the wall in the upper portion of the drawing. Square corner block 2600 preferably has at least two finished surfaces, the front surface 2610 and a side surface 2630. The square corner block can be rotated so that the two finished surfaces on the front surface 2610 and a side surface 2630 face the desired direction. This is made possible since the square corner block includes alignment channels 2662 positioned at each 90 degree rotation to receive the lift and alignment rings 2670 from a block underneath as described above with reference to FIG. 26 through FIG. 28.

Figure 39:
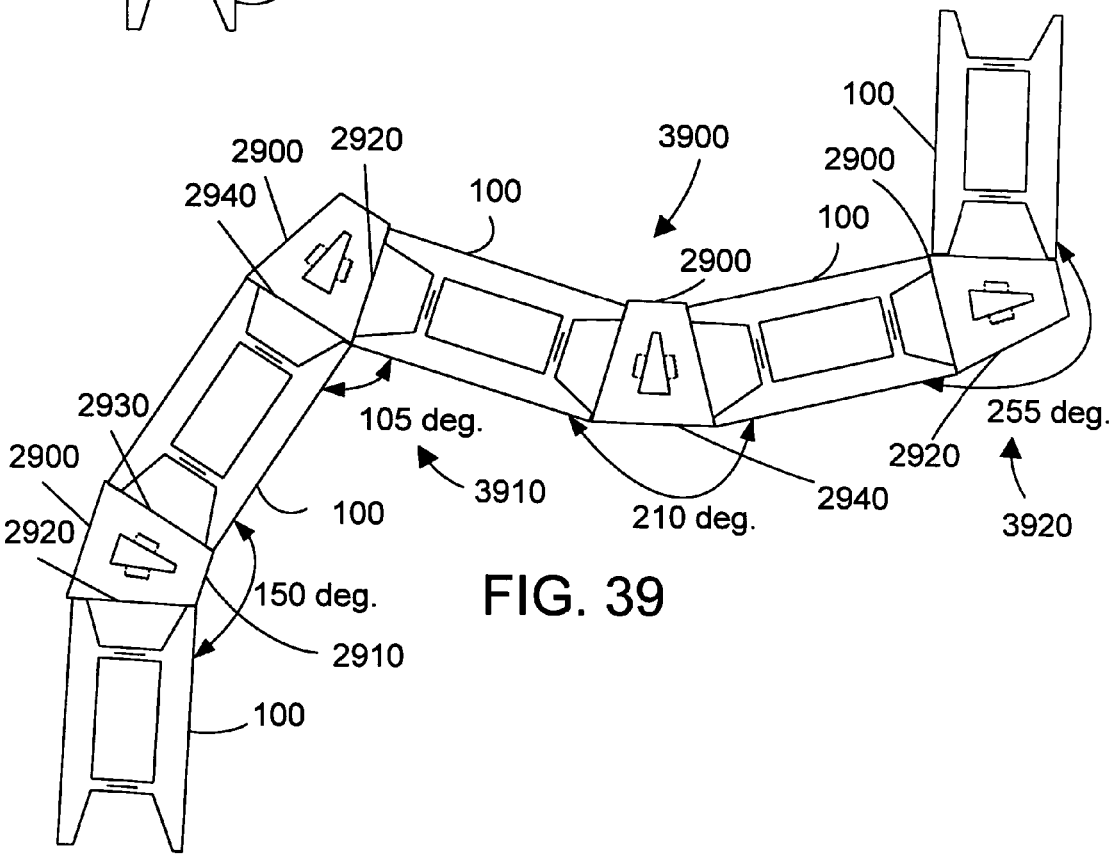
FIG. 39 is a top view of a wall built in accordance with the wall system and method of the preferred embodiments showing various uses of the 30 degree corner block in the wall system.

FIG. 39 shows another wall 3900 that includes a 30 degree block 2900 in the wall system of the preferred embodiments. This wall system illustrates the use of the 30 degree corner block 2900 described above and shown in FIG. 29 through FIG. 31. In FIG. 39, the fill dirt is assumed to be above the wall in the upper portion of the drawing. A 30 degree corner block 2900 is placed between two main blocks 100. One side of the two main blocks is disposed on both sides of the 30 degree block 2900 and preferably comes in contact with both side surfaces 2920, 2930 of the 30 degree corner block 2900. When the front face 2910 of the 30 degree block 2900 is placed toward the front of the wall (away from the dirt), the angle between the faces of the two main blocks is 150 degrees. When the back surface 2940 of the 30 degree block 2900 is placed toward the front of the wall (away from the dirt), the angle between the faces of the two main blocks is 210 degrees. The 30 degree corner block 2900 can be used in a second configuration. In the second configuration, the 30 degree corner block 2900 is placed with the back surface 2940 next to the side surface of the main block and a side surface 2920 next to the next main block 100. This second configuration is used to produce an inside corner 3910 of 105 degrees or an outside corner 3920 of 255 degrees 3920. The 30 degree corner block 2900 preferably has a finished front surface 2910, and may also have a finished side surface 2920.

Figure 40:
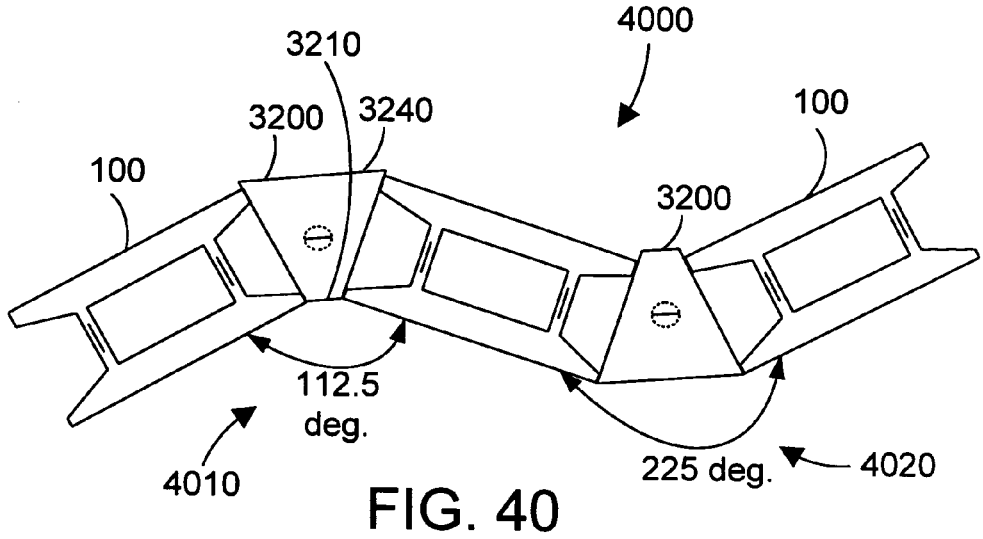
FIG. 40 is a top view of a wall built in accordance with the wall system and method of the preferred embodiments showing the 45 degree corner block in the wall system.

FIG. 40 shows another wall 4000 that includes a 45 degree corner block 3200 in the wall system of the preferred embodiments. This wall system illustrates the use of the 45 degree corner block 3200 described above and shown in FIG. 32 through FIG. 34. In FIG. 40, the fill dirt is assumed to be above the wall in the upper portion of the drawing. A 45 degree corner block 3200 is placed between two main blocks 100. One side of the two main blocks is disposed on both sides of the 45 degree block 3200 and preferably comes in contact with both side surfaces 2920, 2930 of the 45 degree corner block 3200. When the front face 3210 of the 45 degree block 3200 is placed toward the front of the wall (away from the dirt), the angle between the faces of the two main blocks is 112.5 degrees. When the back surface 3240 of the 45 degree block 3200 is placed toward the front of the wall (away from the dirt), the angle between the faces of the two main blocks is 225 degrees. The 45 degree corner block 3200 preferably has a finished front surface 3210, and a finished back surface 3240.

Figure 41:
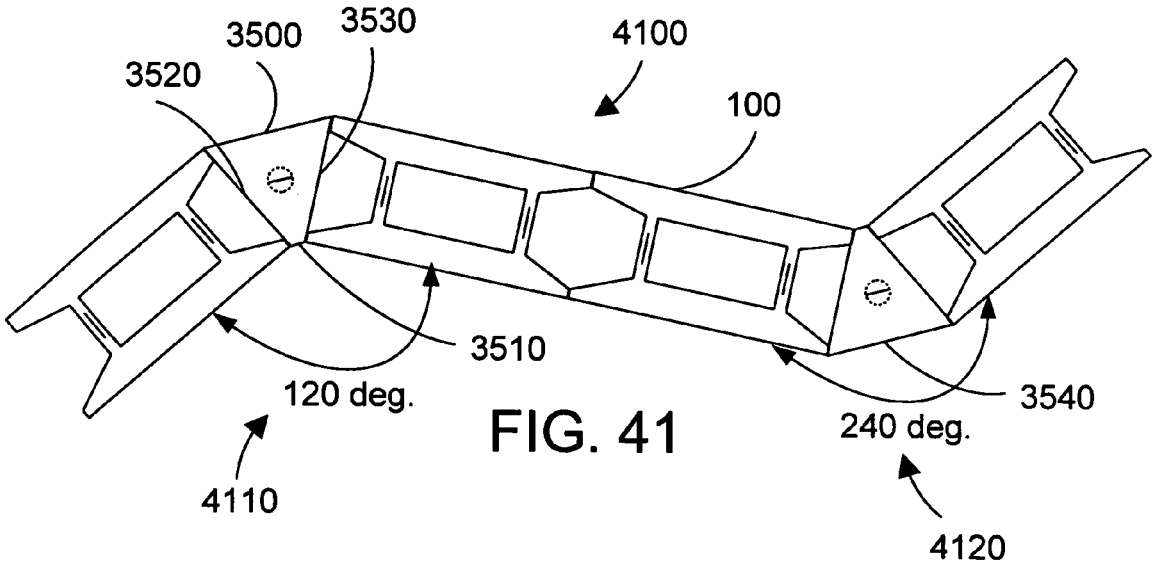
FIG. 41 is a top view of a wall built in accordance with the wall system and method of the preferred embodiments showing the 60 degree corner block in the wall system.

FIG. 41 shows another wall 4100 that includes a 60 degree corner block 3500 in the wall system of the preferred embodiments. This wall system illustrates the use of the 60 degree corner block 3500 described above and shown in FIG. 35 through FIG. 37. In FIG. 41, the fill dirt is assumed to be above the wall in the upper portion of the drawing. A 60 degree corner block 3500 is placed between two main blocks 100. One side of the two main blocks is disposed on both sides of the 60 degree block 3500 and preferably comes in contact with both side surfaces 3520, 3530 of the 60 degree corner block 3500. When the front face 3510 of the 60 degree block 3500 is placed toward the front of the wall (away from the dirt), the angle between the faces of the two main blocks is 120 degrees. When the back surface 3540 of the 60 degree block 3500 is placed toward the front of the wall (away from the dirt), the angle between the faces of the two main blocks is 240 degrees. The 60 degree corner block 3500 preferably has a finished front surface 3510, and a finished back surface 3540.

Figure 42:
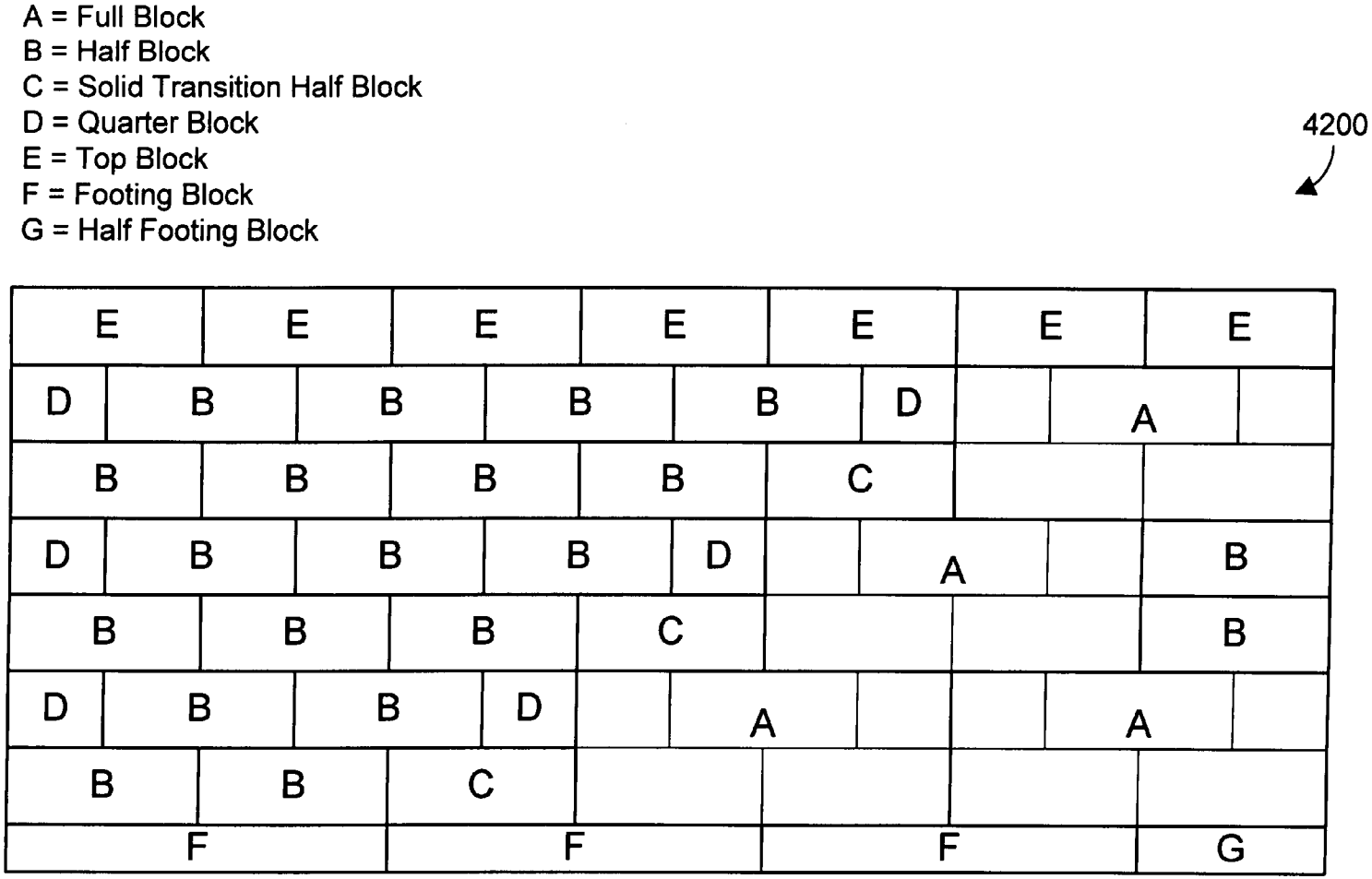
FIG. 42 is a front view of a wall built in accordance with the wall system and method of the preferred embodiments showing the various different blocks in the wall system and how they are used in building a wall.

FIG. 42 shows another wall 4200 in the wall system of the preferred embodiments using various blocks described above. This wall system does not show the use of corner blocks, but the features of this wall can be combined with the corner blocks as shown in the wall systems of FIG. 38 through FIG. 41. The letters on the blocks in FIG. 42 identify their type. The blocks labeled "A" are full blocks, such as block 100 in FIGS. 1–7. The blocks labeled "B" are half blocks, such as block 1600 in FIGS. 16–19. The blocks labeled "C" are transition blocks, such as block 2000 in FIG. 20. The blocks labeled "D" are quarter blocks, such as block 2200 in FIGS. 22–23. The blocks labeled "E" are top blocks, such as block 2400 in FIG. 24. The blocks labeled "F" are footing blocks, such as block 800 shown in FIGS. 8 and 9. And the block labeled "G" represents half of a footing block, such as half of block 800 in FIGS. 8 and 9.

The wall 4200 shows the use of different types of blocks disclosed herein. A quarter block D is used in conjunction with a transition block C when the wall transitions from full blocks A to half blocks B, or vice versa. In addition, a quarter block D may be used at the end of a wall of half blocks B, as shown at the left end of wall 4200 in FIG. 42. Top block E finishes off the wall. In this particular example, we assume that dirt will be backfilled and grass will be planted in the dirt on the back side of the top block. For this example, the middle top blocks would have a finished front, top and back. The top blocks on each end will also have a finished front, top and back, but may additionally have another finished end at the edge of the wall if the edge of the wall is exposed.

The wall 4200 shown in FIG. 42 includes many of the different blocks described herein. Note, however, that a wall system of the preferred embodiments does not necessarily include all of these blocks. For the wall system to work well, it must include the main block, half block, and quarter block. The transition block is also preferably included, but could be omitted if required. The footing block and top blocks are optional, and depend on the specific application. However, the combination of the footing block, main block, half block, quarter block, transition block, and top block as shown in FIG. 42 provides a complete wall system with significant advantages over the prior art.

Note that the inclusion of a half block and quarter block in the wall system of the preferred embodiments allows building walls with turns that have a much smaller radius than is possible using only the main block 100. For example, half blocks may be used to create an inside or outside turn with a radius of approximately 15 feet (4.6 m). Quarter blocks may be used to create an inside or outside turn with a radius of approximately 8 feet (2.4 m). Providing turns in retaining walls is very common, and the wall system of the preferred embodiments gives a designer substantial flexibility in deciding where the retaining wall can go.

Figure 43:
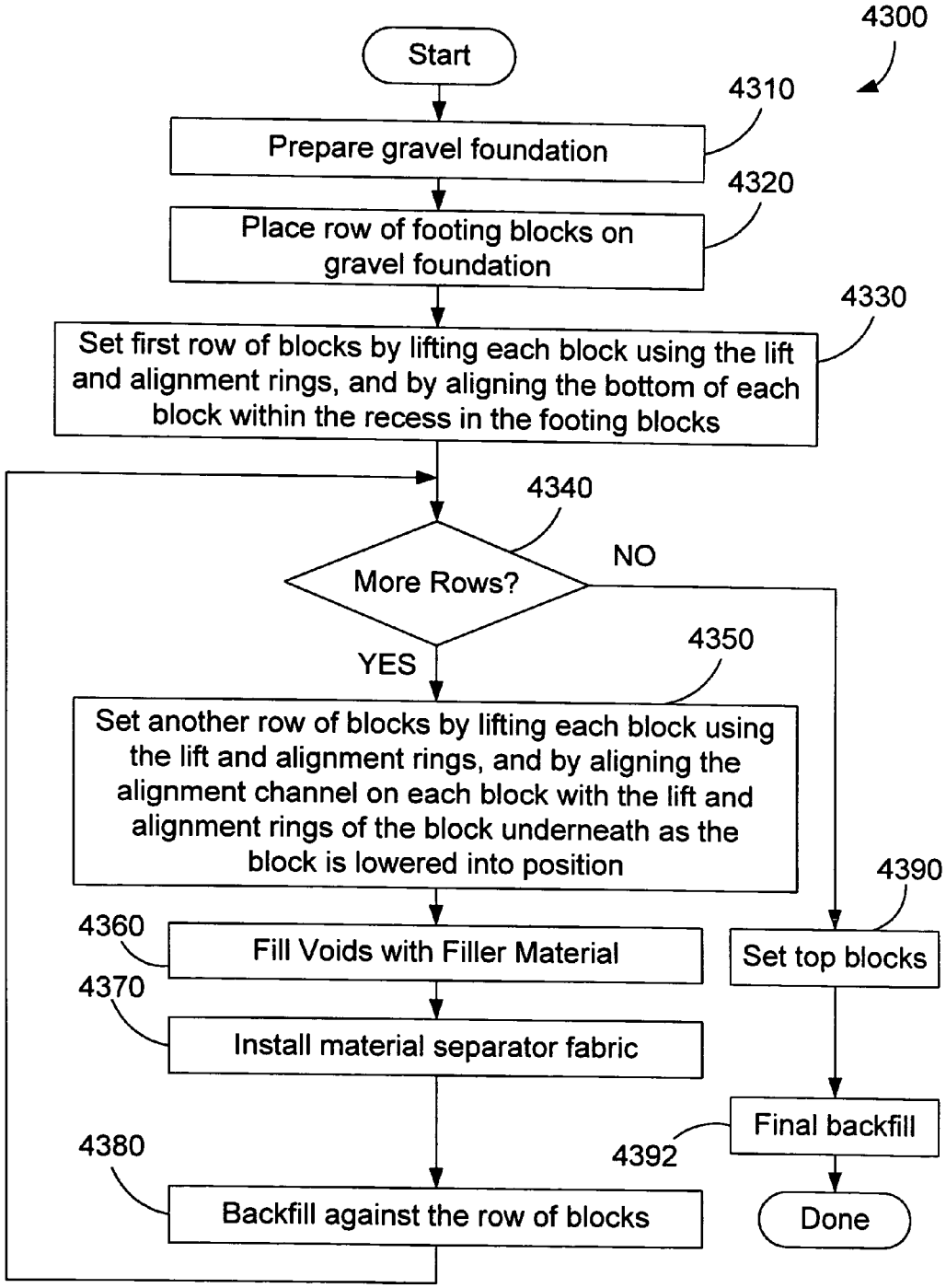
FIG. 43 is a flow diagram of a method for constructing a wall using the blocks of the preferred embodiments.

Referring now to FIG. 43, a method 4300 is used to construct a wall using the wall system disclosed herein. In most applications, a 12 inch bed of gravel (represented as 1010 in FIG. 10) is prepared as the foundation for the wall (step 4310). A row of footing blocks is then placed on the gravel foundation (step 4320). A first row of blocks is then set in place by using the lift and aligning rings to lift the block, and lowering the block within the recess in the footing blocks while keeping block tight against the adjacent block (step 4330). If more rows of blocks are needed (step 4340=YES), another row of blocks is then set in place (step 4350). Note, however, that step 4350 is different than step 4330. Instead of fitting the bottom of the block within the recess in the footing blocks, the alignment channel on the bottom of the block is aligned with the lift and alignment rings on the block below as the block is lowered into position. Once the full row of blocks has been set in place, the voids in the blocks are filled with suitable filler material (step 4360). Material separator fabric is then installed (step 4370). The back of the wall is then backfilled (step 4380). Steps 4350, 4360, 4370 and 4380 are repeated until there are no more rows that need to be placed (step 4340=NO). At this point, the top blocks are set (step 4390), and the final backfill is performed (step 4392).

Note that FIGS. 38–41 described above only show the first course for the sake of clarity. Additional courses could be used and have staggered blocks as shown in FIG. 10, but corner blocks are not staggered.

Note that the steps shown in method 4300 of FIG. 43 are not all required in the method of the preferred embodiments. For example, if no footing blocks are needed, step 4320 may be omitted. If no foundation is required, step 4310 may be omitted. If no top blocks are needed, steps 4390, 4393 and 4394 may be omitted. The preferred embodiments extends to any and all methods for building a wall using the wall system described herein. Furthermore, variations in method 4300 are also within the scope of the preferred embodiments. For example, more than one row, and even the entire wall, could be built before filling voids (step 4360), installing material separator fabric (step 4370) or backfilling (step 4380).

Note that the drawings herein do not show any dimensions for the various blocks. The preferred embodiments expressly extend to any size and dimension for the blocks disclosed herein. In the most preferred application, the blocks have particular dimensions, listed below. The main block 100 has a height of 3.0 feet (91 cm), a width of 8.0 feet (244 cm), and a depth of 44 inches (112 cm). The footing block 800 has a height of 12 inches (30.5 cm), a width of 92 inches (2.3 m), and a depth of 60.75 inches (1.5 m). The half block 1600 and transition block 2000 have a height of 1.5 feet (46 cm), a width of 4.0 feet (122 cm), and a depth of 44 inches (112 cm). The quarter block 2200 has a height of 1.5 feet (46 cm), a width of 2.0 feet (61 cm), and a depth of 44 inches (112 cm). The top block 2400 and 2500 has a preferred height of 9 inches (23 cm), 1.5 feet (46 cm), or 3.0 feet (91 cm) with a preferred width of 4.0 feet (122 cm) or 8.0 feet (244 cm). The square corner block 2600 has a height of 1.5 feet (46 cm), a width of 4.0 feet (122 cm), and a depth of 4.0 feet (122 cm). The 30 degz. corner block 2900 has a height of 1.5 feet (46 cm), a back face 2940 of 4.0 feet (122 cm), a depth of 4.0 feet (122 cm), and a front face 2910 of 22.25 inches. The 45 deg. corner block 3200 has a height of 1.5 feet (46 cm), a back face 3240 of 4.0 feet (122 cm), a depth of 4.0 feet (122 cm) and a front face 3210 of 8.25 inches. The 60 deg. corner block 3500 has a height of 1.5 feet (46 cm), a back face 3540 of 4.0 feet (61 cm), a depth of 4.0 feet (122 cm) and a front face 3510 of 2 inches, or the 60 deg. corner block can be triangular shaped with 4.0 feet (122 cm) sides and not have a front face.

Note that the dimensions of the block and its internal reinforcing structure may be scaled to accommodate different load-bearing requirements. An individual block or the entire system may be either enlarged or reduced as necessary. Thus, if a bridge that must bear a freight train needs to be supported by the block of the present invention, its dimensions could be scaled up to provide for larger voids, into which rebar and concrete could be placed to provide a very strong wall capable of bearing substantial loads. Also a precast, prestress fitting could be formed into the blocks to allow for use in a cabling system to add additional strength to a wall. Such a cabling system could be used, for example, to hold parallel retaining walls on a roadway approach. Additionally the blocks can be specially cast to form fit sewage pipes and other structures with the blocks.

The units herein are expressed in both English and metric units. The preferred embodiments are implemented in English units, and any variation between the stated English units and their metric equivalents is due to rounding errors, with the English units being the more correct measurement of the two.

While the invention has been particularly shown and described with reference to preferred embodiments thereof, it will be understood by those skilled in the art that various changes in form and details may be made therein without departing from the spirit and scope of the invention. For example, a block may be made in a variety of different sizes, as discussed above. In addition, the size, number and geometries of the block surfaces and voids in the block may vary from that disclosed herein. Furthermore, while the block herein is described as being used for retaining walls, it is equally within the scope of the preferred embodiments to use the building block for other purposes, such as building construction.

The invention claimed:

1. A corner block comprising:

a back surface;

first and second side surfaces coupled to the back surface;

a top surface coupled to the back surface and to the first and second side surfaces, wherein the top surface includes at least one alignment device, each alignment device comprising a device for lifting the block when the block is being placed; and a bottom surface coupled to the back surface and to the first and second side surfaces, the bottom surface including at least one recess positioned to receive at least one alignment device of a previously-placed block to align the block with respect to the previously-placed block.

2. The block of claim 1 wherein each alignment device comprises a substantially semicircular portion of material protruding from the top surface.

3. The block of claim 2 wherein the semicircular portion of material is attached to a reinforcing structure within the block.

4. The block of claim 2 wherein the semicircular portion of material comprises rebar.

5. The block of claim 1 further comprising at least one void extending from the top surface to the bottom surface.

6. The block of claim 1 wherein the block comprises a mixture of sand, gravel, water, and cement in a mix rated at approximately 4000 pounds per square inch (280 kilograms per square centimeter).

7. The block of claim 1 wherein an angle between the first and second side surfaces is chosen from a group consisting of: 30, 45 and 60 degrees.

8. The block of claim 1 wherein the top surface and bottom surface of the block are both substantially square.

9. A corner block comprising:

a back surface;

first and second side surfaces coupled to the back surface;

a top surface coupled to the back surface and to the first and second side surfaces, wherein the top surface includes at least one alignment device, each alignment device comprising a device for lifting the block when the block is being placed;

a bottom surface coupled to the back surface and to the first and second side surfaces, the bottom surface including at least one recess positioned to receive at least one alignment device of a previously-placed block to align the block with respect to the previously-placed block; and wherein an angle between the first and second side surfaces is chosen from a group consisting of: 30, 45 and 60 degrees.

10. A corner block comprising:

a back surface;

first and second side surfaces coupled to the back surface;

a top surface coupled to the back surface and to the first and second side surfaces, wherein the top surface includes at least one alignment device, each alignment device comprising a device for lifting the block when the block is being placed;

a bottom surface coupled to the back surface and to the first and second side surfaces, the bottom surface including at least one recess positioned to receive at least one alignment device of a previously-placed block to align the block with respect to the previously-placed block; and wherein the top surface and bottom surface of the block are both substantially square.

11. A wall system for building a wall comprising:

a main block having a height and a width;

a corner block;

wherein the main block and the corner block each comprise:

a back surface;

a first side surface and a second side surface coupled to the back surface;

a top surface coupled to the back surface and to the first side surface and the second side surface, wherein the top surface includes at least one lift and alignment device for lifting the block when the block is being placed, each lift and alignment device aligning a subsequently-placed block with respect to the block; and a bottom surface coupled to the back surface and to the first and second side surfaces, the bottom surface including at least one recess positioned to receive at least one lift and alignment device of a previously-placed block.

12. The wall system of claim 11 wherein the corner block has an angle between the first side surface and the second side surface chosen from a group consisting of: 30, 45 and 60 degrees.

13. The wall system of claim 11 wherein the top surface and bottom surface of the corner block are both substantially square.

14. The wall system of claim 11 wherein the corner block is approximately half the height of the main block and approximately one fourth of the width of the main block.

15. The wall system of claim 11 wherein the back surface of the corner block has a finished surface.

16. The wall system of claim 11 wherein the back and front surface of the corner block has a finished surface.

17. The wall system of claim 11 wherein the front surface and the first side surface of the corner block has a finished surface.

18. The wall system of claim 11 further comprising:

a top block that is used to finish the top of the wall;

a half block that is approximately half the height of the main block and approximately half the width of the main block; and a quarter block that is approximately half the height of the main block and approximately one fourth of the width of the main block.

19. The wall system of claim 11 further comprising a substantially solid transition block that is approximately half the height of the main block and approximately half the width of the main block.

20. The wall system of claim 11 further comprising a footing block that has a back-to-back distance that is greater than the main block.

21. A wall system for building a wall comprising:

a main block having a height and a width;

a corner block;

wherein the main block and the corner block each comprise:

a back surface;

a first side surface and a second side surfaces coupled to the back surface;

a top surface coupled to the back surface and to the first side surface and the second side surface, wherein the top surface includes at least one lift and alignment device for lifting the block when the block is being placed, each lift and alignment device aligning a subsequently-placed block with respect to the block; and a bottom surface coupled to the back surface and to the first and second side surfaces, the bottom surface including at least one recess positioned to receive at least one lift and alignment device of a previously-placed block; and wherein the corner block has an angle between the first side surface and the second side surface chosen from a group consisting of: 30, 45 and 60 degrees.

22. A wall system for building a wall comprising:

a main block having a height and a width;

a corner block;

wherein the main block and the corner block each comprise:

a back surface;

a first side surface and a second side surfaces coupled to the back surface;

a top surface coupled to the back surface and to the first side surface and the second side surface, wherein the top surface includes at least one lift and alignment device for lifting the block when the block is being placed, each lift and alignment device aligning a subsequently-placed block with respect to the block; and a bottom surface coupled to the back surface and to the first and second side surfaces, the bottom surface including at least one recess positioned to receive at least one lift and alignment device of a previously-placed block; and wherein the top surface and bottom surface of the corner block are substantially square.

23. A method for building a block wall comprising the steps of:

(A) laying a first course of blocks having a corner block disposed between a first and a second main block, each main block and corner block in the first course comprising:

(1) a back surface;

(2) first and second side surfaces coupled to the back surface;

(3) a top surface coupled to the back surface and to the first and second side surfaces, wherein the top surface includes at least one lift and alignment device for lifting the block when the block is being placed, each lift and alignment device aligning a subsequently-placed block with respect to the block; and (4) a bottom surface coupled to the back surface and to the first and second side surfaces, the bottom surface including at least one recess positioned to receive at least one lift and alignment device of a previously-placed block;

wherein the step of laying the first course of blocks comprises the steps of:

(A1) lifting each block by at least one lift and alignment device; and (A2) placing the block in a desired location in the wall;

(B) laying subsequent courses of blocks, each block in each subsequent course being aligned with at least one previously-laid block by placing the recess of the bottom surface of the block being laid in a position to receive at least one lift and alignment device on at least one previously-laid block.

24. The method of claim 23 wherein an angle between the first side surface of the first main block and the first side surface of the second main block is an angle other than 90 degrees.

25. The method of claim 23 wherein an angle between the first side surface of the first main block and the first side surface of the second main block is an angle chosen from the group consisting of 105, 150, 210, 112.5, 225, 120 and 240 degrees.

26. The method of claim 23 further comprising the steps of:

preparing a foundation; and laying a plurality of footing blocks on the foundation, wherein the first course of blocks in step (A) is laid atop the footing blocks.

27. The method of claim 23 further comprising the steps of:

(C) installing a material separator fabric on the back surfaces of the blocks;

(D) filling at least one void in the blocks with a filler material; and (E) backfilling against the blocks.

28. The method of claim 23 wherein the step of laying the first course of blocks includes placing the first side surface of the first main block in contact with the first side surface of the corner block, and placing the first side surface of the second main block in contact with the second side surface of the corner block.

29. The method of claim 23 wherein the step of laying the first course of blocks includes placing the first side surface of the first main block in contact with the back surface of the corner block, and placing the first side surface of the second main block in contact with the first side surface of the corner block.

* * * * *